US010712698B2

(12) United States Patent
Mukai et al.

(10) Patent No.: US 10,712,698 B2
(45) Date of Patent: Jul. 14, 2020

(54) IMAGE FORMING APPARATUS

(71) Applicant: CANON KABUSHIKI KAISHA, Tokyo (JP)

(72) Inventors: Takashi Mukai, Kawasaki (JP); Kazuhiro Okubo, Kawasaki (JP); Takahiro Kawamoto, Yokohama (JP); Masanori Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/289,755

(22) Filed: Mar. 1, 2019

(65) Prior Publication Data

US 2019/0286031 A1 Sep. 19, 2019

(30) Foreign Application Priority Data

Mar. 19, 2018 (JP) ..... 2018-051195

(51) Int. Cl.

| | |
|---|---|
| ***G03G 15/22*** | (2006.01) |
| ***G03G 15/00*** | (2006.01) |
| ***G03G 15/02*** | (2006.01) |
| ***G03G 15/01*** | (2006.01) |
| ***G03G 15/16*** | (2006.01) |

(52) U.S. Cl.

CPC ..... *G03G 15/5004* (2013.01); *G03G 15/0142* (2013.01); *G03G 15/0189* (2013.01); *G03G 15/0258* (2013.01); *G03G 15/0266* (2013.01); *G03G 15/161* (2013.01); *G03G 2215/00025* (2013.01)

(58) Field of Classification Search

CPC ..... G03G 15/5004; G03G 15/0142; G03G 15/0189; G03G 15/0285; G03G 15/0266; G03G 15/161; G03G 2215/00025

See application file for complete search history.

(56) References Cited

U.S. PATENT DOCUMENTS

| | | | | |
|---|---|---|---|---|
| 6,314,251 | B1 | 11/2001 | Gomi et al. | |
| 6,449,448 | B2 | 9/2002 | Bessho et al. | |
| 2010/0135685 | A1 * | 6/2010 | Chang | G03G 15/065 399/55 |

(Continued)

FOREIGN PATENT DOCUMENTS

| | | | |
|---|---|---|---|
| JP | 2000214651 | A | 8/2000 |
| JP | 2001194951 | A | 7/2001 |

(Continued)

*Primary Examiner* — G. M. A Hyder
*Assistant Examiner* — Michael A Harrison
(74) *Attorney, Agent, or Firm* — Rossi, Kimms & McDowell LLP

(57) ABSTRACT

In an image forming operation of transferring one developer image to a recording material, when a plurality of image forming portions include a non-image forming portion that is an image forming portion which does not form a developer image on an image bearing member, applying means for applying a charging bias to a charging member which comes into contact with and charges the image bearing member applies a second charging bias to the charging member in the non-image forming portion, the second charging bias having a same polarity as a first charging bias for forming a developer image and being a voltage equal to or lower than a discharge start voltage.

17 Claims, 11 Drawing Sheets

(56) References Cited

U.S. PATENT DOCUMENTS

| | | | | |
|---|---|---|---|---|
| 2012/0301166 | A1* | 11/2012 | Soda | G03G 21/0064 399/129 |
| 2014/0370426 | A1* | 12/2014 | Ishizuka | G03G 9/08755 430/105 |
| 2019/0302638 | A1* | 10/2019 | Tanaka | G03G 21/10 |

FOREIGN PATENT DOCUMENTS

| | | | |
|---|---|---|---|
| JP | 2006337684 | A | 12/2006 |
| JP | 2011203758 | A | 10/2011 |

* cited by examiner

DURING FULL-COLOR MODE

DURING POST-ROTATION SEQUENCE (CLEANING PROCESS OF CHARGING ROLLER)

DURING MONOCHROME MODE B ACCORDING TO FIRST EMBODIMENT

DURING MONOCHROME MODE ACCORDING TO FIRST COMPARATIVE EXAMPLE

IMAGE FORMING APPARATUS

BACKGROUND OF THE INVENTION

Field of the Invention

The present disclosure relates to an image forming apparatus which forms an image on a recording material using an electrophotographic technique.

Description of the Related Art

Among image forming apparatuses such as copiers and printers which use an electrophotographic system, 4-color full color image forming apparatuses adopting an intermediate transfer system have a mode such as a monochrome mode in which image formation is performed using only a part (one) of a plurality of image forming portions. In doing so, in image forming portions not performing image formation (hereinafter, non-image forming portions), a charging bias to be applied to charging means is generally turned off or set lower than during image formation. In addition, by selecting and executing such an image formation mode in accordance with image information and the like, deterioration of an image bearing member (a photosensitive drum) in non-image forming portions can be suppressed.

Meanwhile, in order to achieve cost reduction by reducing the size and the number of components of image forming apparatuses, image forming apparatuses adopting a so-called image bearing member cleaner-less system in which cleaning means for removing and recovering toner remaining on an image bearing member are not provided are being proposed. In an image forming apparatus adopting an image bearing member cleaner-less system, repetitively performing image forming operations and various image stabilizing controls using a toner may result in the toner adhering to or accumulating on charging means (hereinafter, a contact charging member) adopting a contact charging system. This occurs when a part of the toner remaining on the image bearing member electrostatically adheres to the contact charging member due to a surface potential difference between the contact charging member and the image bearing member. As a result, a problem arises in that a change in a charging capability of the contact charging member causes the contact charging member to lose its ability to uniformly charge an image bearing member surface and causes an image density variation to occur.

As a solution to this problem, a method of cleaning a contact charging member by ejecting toner having adhered to or accumulated on the contact charging member onto an image bearing member is proposed. For example, in Japanese Patent Application Laid-open No. 2001-194951, in an image forming apparatus adopting a contact charging system and an image bearing member cleaner-less system, toner remaining on an image bearing member surface after passing through a transfer portion is temporarily recovered to a contact charging member. Subsequently, during a non-image formation period such as a post-rotation step, the recovered toner is ejected onto an image bearing member using a surface potential difference between the contact charging member and the image bearing member and recovered once again by developing means. Alternatively, the recovered toner is transferred onto an intermediate transfer member by transfer means and cleaned by cleaning means provided on the intermediate transfer member. Accordingly, even when image forming operations and various image stabilizing controls using a toner are repetitively performed, an excessive amount of toner can be prevented from adhering to and accumulating on the contact charging member. Therefore, an image forming apparatus can be provided which suppresses image density variation by performing such a cleaning process and which realizes a small size since an image bearing member need not be provided with a dedicated cleaning apparatus.

SUMMARY OF THE INVENTION

However, in image forming apparatuses adopting an image bearing member cleaner-less system as described above, there are several problems when executing an image formation mode in which a non-image forming portion is present among image forming portions arranged in plurality.

As a first problem, in the non-image forming portion, when a charging bias to be applied to a contact charging member is turned off or set lower than during image formation, a non-uniform density image or the like caused by ejection of toner (hereinafter, contaminated toner) adhered to the contact charging member may sometimes occur. This occurs because a surface potential difference between the contact charging member and the image bearing member is oriented so as to eject the contaminated toner toward the image bearing member. In addition, when the contaminated toner is ejected, a surface potential non-uniformity or the like of the image bearing member may cause a non-uniformity in an amount by which the contaminated toner is ejected to be created. When non-uniform contaminated toner once ejected onto the image bearing member is recovered once again by the contact charging member, a state where the contact charging member is non-uniformly contaminated by the toner (hereinafter, a toner contamination non-uniformity) is created. Subsequently, when image formation is next performed by the same image forming portion, the toner contamination non-uniformity of the contact charging member prevents the image bearing member from being uniformly charged and results in an occurrence of image defects such as a non-uniform density image in a printed portion and background fogging in a non-printed portion.

There is also a problem when, in order to suppress occurrences of such image defects, a transfer bias is controlled such that the contaminated toner is recovered by another image forming portion on a downstream side of a movement direction of an intermediate transfer member so as to prevent the contaminated toner from being recovered once again by the contact charging member upon ejection. In an image forming portion during an image forming operation, since the surface potential difference between the contact charging member and the image bearing member is oriented so that the contaminated toner is recovered by the contact charging member, a toner contamination non-uniformity of the contact charging member occurs in a similar manner to the non-image forming portion described above. In addition, a change in an image tinge may occur due to toners of different colors being recovered by developing means to cause color mixing. As described above, the ejection of contaminated toner from the contact charging member of a non-image forming portion may cause various image defects.

On the other hand, in the non-image forming portion, when a charging bias of a similar magnitude to during image formation is applied to the contact charging member, contaminated toner can be retained without ejecting the contaminated toner from the contact charging member. Accordingly, an occurrence of a non-uniform density image or the like can be suppressed. However, as a second problem, discharge from the contact charging member promotes deterioration of the image bearing member of the non-image forming portion in the form of abrasion and adhesion of discharge products even though the image bearing member is not used for image formation.

A third problem is that, as in the conventional example described earlier, a wait time of a user increases and printing productivity declines when performing a cleaning process of the contact charging member during a non-image formation period such as a post-rotation step. However, by performing the cleaning process of the contact charging member before an image formation mode in which a non-image forming portion is present, an occurrence of a non-uniform density image or the like due to ejection of the contaminated toner of the contact charging member can be suppressed. In addition, since there is no need to apply a charging bias to the non-image forming portion in order to suppress ejection of the contaminated toner, deterioration of the image bearing member is not promoted. However, when there is a next successive print job in an image formation mode in which the non-image forming portion is present, since a cleaning process must be performed before the print job, a wait time of the user is increased and printing productivity of the image forming apparatus declines. In particular, when an image formation mode having a non-image forming portion is performed immediately after performing full-color image formation involving all of the image forming portions, since a cleaning process cannot be inserted in advance so that the wait time of the user is not affected, the wait time of the user increases.

As described above, in an image forming apparatus adopting an image bearing member cleaner-less system, it is difficult to simultaneously achieve the three objectives of: reducing a wait time of a user; suppressing ejection of contaminated toner of a contact charging member of a non-image forming portion; and suppressing deterioration of an image bearing member of the non-image forming portion.

An object of the present disclosure is to provide a technique which enables an image forming apparatus including a plurality of image forming portions to reduce a wait time of a user and suppress an occurrence of a non-uniform density image or the like due to ejection of toner adhering to a contact charging member while suppressing deterioration of an image bearing member.

In order to achieve the object described above, an image forming apparatus according to the present disclosure includes:

a plurality of image forming portions each including an image bearing member which is rotatable, a charging member which comes into contact with the image bearing member and charges a surface of the image bearing member, and a developer carrying member which supplies toner to the image bearing member to form a toner image, the image forming portions being configured to form a toner image on the image bearing member;

an intermediate transfer member to which the toner image formed on the image bearing member is transferred;

a transferring member which transfers, to a recording material, the toner image having been transferred to the intermediate transfer member;

a charging voltage applying portion which applies a charging voltage to the charging member; and a control portion which controls the charging voltage applying portion, wherein the image forming portions are each configured to, in an image forming operation of forming the toner image on the recording material, recover toner remaining on the image bearing member without being transferred to the intermediate transfer member, using the developer carrying member, and wherein in the image forming operation, when the toner image is not formed in the image forming portion, which is a part of the plurality of image forming portions, the control portion controls the charging voltage applying portion so that a second charging voltage is applied to the charging member of the image forming portion that does not form the toner image, the second charging voltage having a smaller absolute value than a first charging voltage that is a charging voltage for forming the toner image, and having a same polarity as the first charging voltage.

In order to achieve the object described above, an image forming apparatus according to the present disclosure includes:

a plurality of image forming portions each including an image bearing member which is rotatable, a charging member which comes into contact with the image bearing member and charges a surface of the image bearing member, and a developer carrying member which supplies toner to the surface of the image bearing member having been charged by the charging member, the image forming portions being configured to form a toner image on the image bearing member;

a transferred body which bears and transports a recording material and which transfers the toner image formed on the image bearing member to the recording material;

a charging voltage applying portion which applies a charging voltage to the charging member; and a control portion which controls the charging voltage applying portion, wherein the image forming portions are each configured to, in an image forming operation of forming the toner image on the recording material, recover toner remaining on the image bearing member without being transferred to the recording material, using the developer carrying member, and wherein in the image forming operation, when the toner image is not formed in the image forming portion, which is a part of the plurality of image forming portions, the control portion controls the charging voltage applying portion so that a second charging voltage is applied to the charging member of the image forming portion that does not form the toner image, the second charging voltage having a smaller absolute value than a first charging voltage that is a charging voltage for forming the toner image, and having a same polarity as the first charging voltage.

According to the present disclosure, in an image forming apparatus including a plurality of image forming portions, a wait time of a user can be reduced and an occurrence of a non-uniform density image or the like due to ejection of toner adhering to a contact charging member can be suppressed while suppressing deterioration of an image bearing member.

Further features of the present disclosure will become apparent from the following description of exemplary embodiments with reference to the attached drawings.

DESCRIPTION OF THE EMBODIMENTS

Hereinafter, a description will be given, with reference to the drawings, of embodiments (examples) of the present disclosure. However, the sizes, materials, shapes, their relative arrangements, or the like of constituents described in the embodiments may be appropriately changed according to the configurations, various conditions, or the like of apparatuses to which the disclosure is applied. Therefore, the sizes, materials, shapes, their relative arrangements, or the like of the constituents described in the embodiments do not intend to limit the scope of the disclosure to the following embodiments.

Embodiments

Overall Configuration of Image Forming Apparatus

Figure 1:
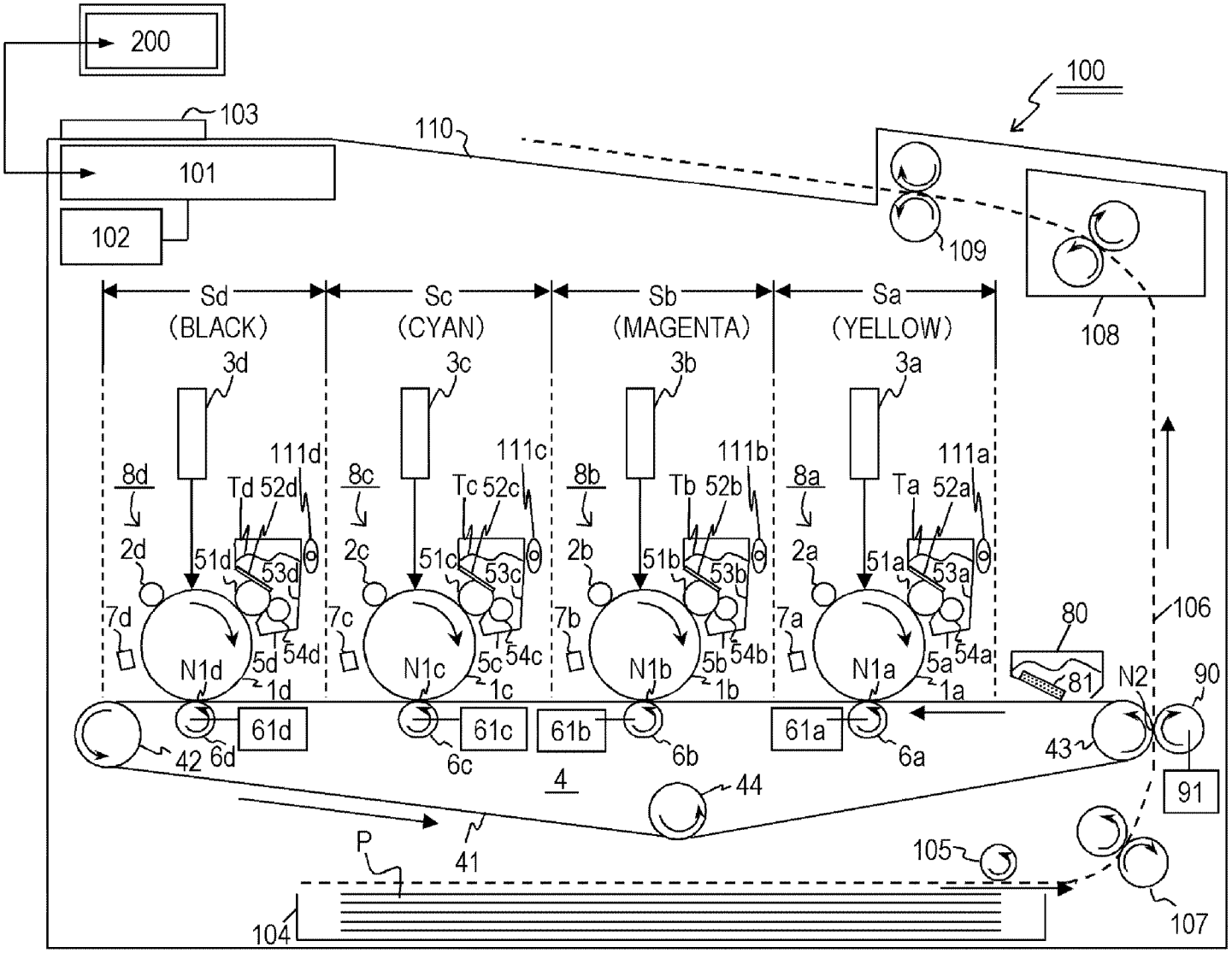
FIG. 1 is a schematic sectional view showing a schematic configuration of an image forming apparatus according to an embodiment of the present disclosure.
Figure 2:
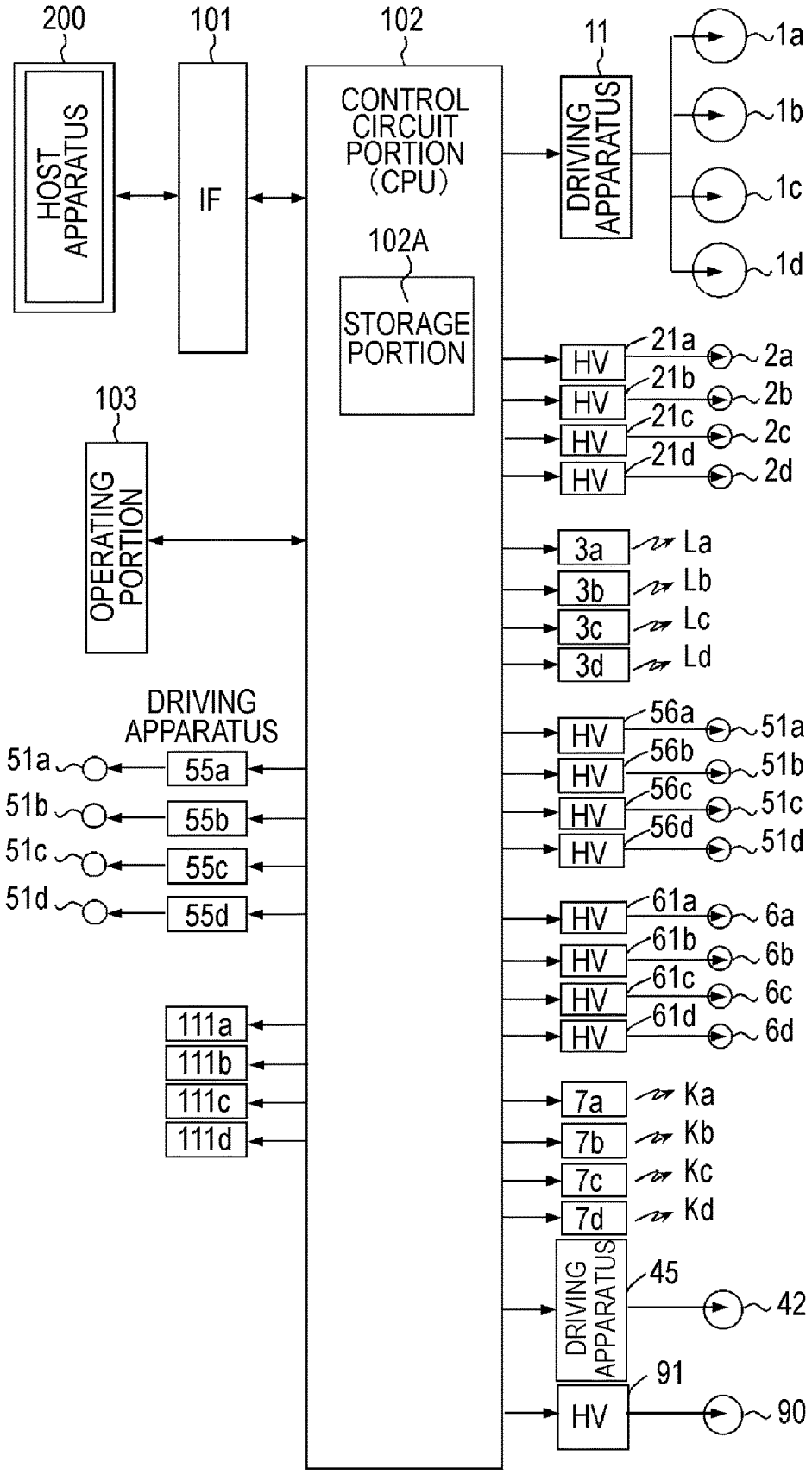
FIG. 2 is a block diagram of a control system of key portions in an image forming apparatus according to an embodiment of the present disclosure.

FIG. 1 is a configuration schematic view of key portions of an image forming apparatus 100 according to the present embodiment. FIG. 2 is a block diagram of a control system of the key portions of the image forming apparatus 100. The apparatus 100 is an electrophotographic color laser beam printer adopting an intermediate transfer system and an in-line system as an example of an image forming apparatus to which the present disclosure can be applied. The apparatus 100 receives an input of an image signal (electric image information) that is input from a host apparatus 200 to a control circuit portion (a CPU: control means) 102 via image signal receiving means (IF) 101. Based on the input image signal, the control circuit portion 102 executes a full-color mode (a multicolor image formation mode) in which image formation in multiple colors is performed on a recording material (a transfer material) P or a monochrome mode (a monochrome image formation mode) in which image formation in a single color is performed on the recording material (a transfer material) P.

The host apparatus 200 is an image reading apparatus (an image reader), a personal computer (PC), a terminal on a network, a communication destination facsimile, a word processor, or the like. The control circuit portion 102 performs transmission and reception of various pieces of electric information to and from an operating portion (a control panel) 103 including a display instrument or the like, the host apparatus 200, and the like. In addition, the control circuit portion 102 monitors and controls operations of respective devices in the apparatus 100 and integrally controls printing operations (image forming operations) of the apparatus 100 in accordance with predetermined control programs and reference tables. The recording material P is a recording medium capable of forming a toner image (a developer image) and is a sheet-like member such as a sheet of paper, an OHT sheet, or a label.

A plurality of image forming portions, namely, in the present embodiment, four (first to fourth) image forming portions S (Sa, Sb, Sc, and Sd) are provided side by side from right to left in a horizontal direction in the drawing and form a developer image in each color by parallel processing. The respective image forming portions S are electrophotographic image forming mechanisms with mutually similar configurations of which a sole difference being a color (in the present embodiment, yellow, magenta, cyan, or black) of a developer (hereinafter, described as a toner) housed in each of their developing apparatuses.

In the present embodiment, configurations and operations of the respective image forming portions Sa, Sb, Sc, and Sd share many common traits. Therefore, in the following description, when the image forming portions need not be particularly distinguished from one another, the suffixes a (yellow), b (magenta), c (cyan), and d (black) added to the reference characters to indicate which element is provided for which color will be omitted and the image forming portions will be collectively described.

Each image forming portion S has a drum-type electrophotographic photoreceptor (hereinafter, described as a drum) 1 as a rotatable image bearing member on which a toner image of a different color is formed as described above. The drum 1 according to the present embodiment has a negatively-charged laminated photosensitive layer constructed by laminating a charge generation layer containing a charge generating material and a charge transport layer (a surface layer) containing a charge transporting material on an outer circumferential surface of a drum substrate.

All of the drums 1 are rotationally driven by a driving apparatus 11 (FIG. 2) controlled by the control circuit portion 102 at a predetermined speed (in the present embodiment, a speed of 100 mm/sec) in a clockwise direction indicated by arrows. A charging roller 2 that is charging means, a scanner 3 that is exposing means (an exposing unit), a developing device 5 that is developing means, a primary transfer roller 6 that is primary transfer means, and a preliminary exposing apparatus 7 that is preliminary exposing means are arranged around the drum 1 as image forming process means that act on the drum 1.

The charging roller 2 as a charging member is means that uniformly charges a surface of the drum 1 to a predetermined polarity and potential. The charging roller 2 is a conductive roller in which a conductive rubber layer is provided on top of a core metal, which is arranged in parallel to and in contact at predetermined pressure with the drum 1, and which rotates so as to follow a rotation of the drum 1. A charging bias (a charging voltage) Vc of a predetermined voltage is applied at a predetermined timing to the core metal of the charging roller 2 from a charging bias power supply 21 as charging bias applying means (a charging voltage applying portion) that is controlled by the control circuit portion 102 as a control portion. When the charging bias Vc with a negative polarity and a predetermined potential is applied to the charging roller 2, a discharge occurs between the charging roller 2 and the drum 1 and a circumferential surface of the rotating drum 1 is uniformly charged to a predetermined potential (a dark potential) VD with a negative polarity.

The scanner 3 is means that performs scanning exposure, using light modulated in accordance with image information, of a surface of the drum 1 having been subjected to a charging process and, in the present embodiment, the scanner 3 is a laser scanner. The scanner 3 outputs a laser beam L modulated in accordance with image information (an electric digital image signal) input to the control circuit portion 102 via the image signal receiving means 101 from the host apparatus 200 to perform scanning exposure of the surface of the drum 1 having been subjected to a charging process. As a result, a potential of an exposed portion of the drum surface attenuates to a light potential VL and, due to an electrostatic contrast between the dark potential VD and the light potential VL, an electrostatic latent image corresponding to image exposure is formed on the drum 1.

The developing device 5 is means that, as a developing portion in the apparatus 100, develops an electrostatic latent image formed on the surface of the drum 1 as a toner image (a developer image) using the toner T charged to a normal charging polarity. In the present embodiment, since the developing device 5 is a reversal developing apparatus adopting a contact developing system and using a nonmagnetic single-component negative toner as the toner T that is a single-component toner and the developing device 5 performs reversal developing of an electrostatic latent image with negative polarity, the normal charging polarity of the toner T is negative. The developing device 5 has a developing roller 51 as a developer carrying member which bears the toner T and which comes into contact with the drum 1 and rotates. In addition, the developing device 5 has a developer restricting member 52 which applies a charge to the toner T and which coats the developing roller 51 with a uniform thin layer of the toner T, a developer storage chamber (a hopper portion) 53 which houses the toner T, a toner supplying roller 54 which supplies the developing roller 51 with the toner T, and the like.

The developing roller 51 is constituted by an elastic rubber material or the like and, as the developing roller 51 is rotationally driven by a driving apparatus 55 that is controlled by the control circuit portion 102, a circumferential surface of the developing roller 51 is coated by a thin layer of the toner T. The developing roller 51 is brought into contact with the drum 1 and a developing bias with a predetermined voltage is applied at a predetermined timing to the developing roller 51 from a developing bias power supply 56 that is controlled by the control circuit portion 102. Accordingly, the toner T adheres to portions of the light potential DL of the drum 1 and the electrostatic latent image is reversely developed as a toner image.

Yellow toner Ta is housed in a developing device 5*a* of a first image forming portion Sa, and a yellow toner image is formed on a drum 1*a*. Magenta toner Tb is housed in a developing device 5*b* of a second image forming portion Sb, and a magenta toner image is formed on a drum 1*b*. Cyan toner Tc is housed in a developing device 5*c* of a third image forming portion Sc, and a cyan toner image is formed on a drum 1*c*. Black toner Td is housed in a developing device 5*d* of a fourth image forming portion Sd, and a black toner image is formed on a drum id. In other words, toner images of different colors are formed among the drums (among the image bearing members) of the first to fourth image forming portions Sa to Sd that are the plurality of image forming portions.

The primary transfer roller 6 as primary transfer means (a primary transfer member) is a conductive roller in the present embodiment and is arranged on a lower surface of the drum 1 via an intermediate transfer belt 41 as an intermediate transfer member (a transferred body) of an intermediate transfer unit 4 to be described later. In addition, the belt 41 is brought into contact with the lower surface of the drum 1 to form a primary transfer position (a primary transfer nip portion) N1. The primary transfer roller 6 rotates so as to follow a rotation of the belt 41.

A predetermined primary transfer bias (a transfer voltage) Vt1 is applied to each primary transfer roller 6 at a predetermined timing from a primary transfer bias power supply 61 that is transfer bias applying means (a transfer voltage applying portion) controlled by the control circuit portion 102. Due to the primary transfer bias Vt1 applied to the belt 41 via each primary transfer roller 6, an electric field with an orientation (polarity) that causes the toner T charged to the normal charging polarity to move from the drum 1 toward the belt 41 is formed at the primary transfer position N1. In the present embodiment, since the normal charging polarity of the toner T is a negative polarity, a voltage with a positive polarity is used as the primary transfer bias Vt1. Accordingly, a toner image on the drum 1 is primarily transferred onto a surface of the belt 41. Moreover, the primary transfer bias power supply 61 can switch the voltage applied to the primary transfer roller 6 during a post-rotation sequence (to be described later) or the like to a primary transfer bias Vt2 with a reverse polarity with respect to during image formation (in the present embodiment, a negative polarity).

The preliminary exposing apparatus 7 as preliminary exposing means (a second exposing means (a second exposing unit)) is means that removes charge by exposing the surface of the drum 1 having passed the primary transfer position N1 but before arriving at the charging roller 2. The preliminary exposing apparatus 7 is controlled by the control circuit portion 102 to output light K (hereinafter, preliminary exposure) at a predetermined timing toward the surface of the drum 1 having passed the primary transfer position N1.

Each image forming portion S adopts an image bearing member cleaner-less system in which the drum 1 is not provided with a dedicated cleaner apparatus. No member comes into contact with the surface of the drum 1 before the surface of the drum 1 having passed the primary transfer position N1 reaches a contact position with the charging roller 2. Accordingly, when the developing device 5 is brought into contact with the drum 1, the toner T remaining on the drum 1 can be recovered by the developing device 5.

The apparatus 100 according to the present embodiment collectively configures the drum 1, the charging roller 2, and the developing device 5 in each image forming portion S as a process cartridge 8 that is attachable to and detachable from an image forming apparatus main body. In the present embodiment, process cartridges 8*a* to 8*d* respectively encapsulating the yellow toner Ta, the magenta toner Tb, the cyan toner Tc, and the black toner Td are sequentially mounted to the first to fourth image forming portions Sa to Sd starting from an upstream side in a movement direction of the belt 41.

In addition, the developing device 5 according to the present embodiment is assembled to the drum 1 so as to be swingable around a spindle (not illustrated). A cam mechanism (a developing apparatus shifting mechanism) 111 that acts on the developing device 5 is arranged as a developing/separating unit in each image forming portion S. The cam mechanism 111 is controlled by the control circuit portion 102 and is selectively transformed into a non-acting state and an acting state with respect to the developing device 5 of each image forming portion S. When the cam mechanism 111 is transformed into the non-acting state, the developing device 5 is swung toward the drum 1 and shifted to a contact position (a developing position) where the developing roller 51 is in contact with the drum 1 with a predetermined pressing force. The developing roller 51 is rotationally driven in a state where the developing device 5 has shifted to the developing position. In addition, when the cam mechanism 111 is transformed into the acting state, the developing device 5 is swung in a direction of separation from the drum 1 and shifts to and held at a separating position (a non-developing position) where the developing roller 51 is separated from the drum 1. Rotation of the developing roller 51 is stopped in a state where the developing device 5 has shifted to the separating position.

The intermediate transfer unit 4 is arranged below the first to fourth image forming portions Sa, Sb, Sc, and Sd. The intermediate transfer unit 4 is movable in a circulatory manner and has a flexible endless belt (an endless belt-like film) 41 as an intermediate transfer member (a second image bearing member) that receives transfer of a toner image from each image forming portion S. The belt 41 is wound in a tautened manner around three rollers as a plurality of supporting members (belt tautening members), namely, a driver roller 42, and a secondary transfer opposing roller 43 and a tension roller 44 arranged parallel to the driver roller 42. When the driver roller 42 is driven by a driving apparatus 45 that is controlled by the control circuit portion 102, the belt 41 rotates in a counterclockwise direction indicated by an arrow. The belt 41 moves (rotates) in approximately a same peripheral velocity (a surface movement speed) as a peripheral velocity of the drum 1 in a forward direction (the counterclockwise direction indicated by an arrow) with respect to a rotation of the drum 1. The secondary transfer opposing roller 43 and the tension roller 44 rotate so as to follow a rotation of the belt 41.

A secondary transfer roller 90 as secondary transfer means (a secondary transfer member) is arranged in a belt winding portion of the secondary transfer opposing roller 43. The secondary transfer roller 90 is a conductive roller in which a superficial layer portion is formed of an elastic material and which is in contact with the roller 43 with a predetermined pressing force and with the belt 41 between the rollers. A contact portion between the secondary transfer roller 90 and the belt 41 constitutes a secondary transfer position (a secondary transfer nip portion) N2. The secondary transfer roller 90 rotates so as to follow a rotation of the belt 41. In addition, a predetermined secondary transfer bias with a predetermined voltage is applied to the secondary transfer roller 90 at a predetermined control timing from a secondary transfer bias power supply 91 that is controlled by the control circuit portion 102.

In the present embodiment, among the plurality of (first to fourth) image forming portions Sa, Sb, Sc, and Sd, the first image forming portion Sa is on a most upstream side and the fourth image forming portion Sd is on a most downstream side in a movement direction of the belt 41 from the secondary transfer position N2. In other words, in the movement direction of the belt 41, the first image forming portion Sa is an image forming portion that is farthest from the secondary transfer position N2 and the fourth image forming portion Sd is an image forming portion that is closest to the secondary transfer position N2.

In addition, in the movement direction of the belt 41, a belt cleaning apparatus 80 as cleaning means that cleans the belt 41 is arranged on an upstream side of the primary transfer position N1*a* of the first image forming portion Sa. The belt cleaning apparatus 80 has a belt cleaning blade 81 as a cleaning member and the belt cleaning blade 81 is in contact with an outer circumferential surface of the belt 41.

A recording material cassette 104 that houses a stack of recording material P is mounted below the intermediate transfer unit 4. The recording material P housed in the recording material cassette 104 is separated and fed one sheet at a time by a rotation of a paper feeding roller 105 that is controlled by the control circuit portion 102, introduced to a sheet path 106 in a vertical direction, and fed to a resist roller pair 107.

The control circuit portion 102 controls the resist roller pair 107 and feeds out the recording material P with respect to the secondary transfer position N2 at a predetermined control timing that is synchronized with a position of a toner image on the belt 41. At the same time, a secondary transfer bias is applied to the secondary transfer roller 90 from the secondary transfer bias power supply 91. Due to the secondary transfer bias (voltage with positive polarity), an electric field with an orientation (polarity) that causes the toner charged to the normal charging polarity (a negative polarity) to move from the belt 41 toward the recording material P is formed at the secondary transfer position N2. Accordingly, the toner image formed on a surface of the belt 41 is transferred to a surface of the recording material P being sandwiched and transported at the secondary transfer position N2.

In the present embodiment, toner (secondary transfer residual toner) that remains on the belt 41 without being transferred to the recording material P is removed and recovered by the belt cleaning apparatus 80 in a secondary transfer process.

The recording material P having received transfer of the toner image at the secondary transfer position N2 is separated from the surface of the belt 41 and introduced to a fixing apparatus 108 arranged above the secondary transfer roller 90. The recording material P is sandwiched and transported at a fixing nip portion of the fixing apparatus 108 and is subjected to pressure and heat. As a result, an unfixed toner image on the recording material is fixed as a fixed image. The recording material P having exited the fixing apparatus 108 is discharged at a discharge roller pair 109 to a discharge tray 110 as an image-formed object.

Figure 3:
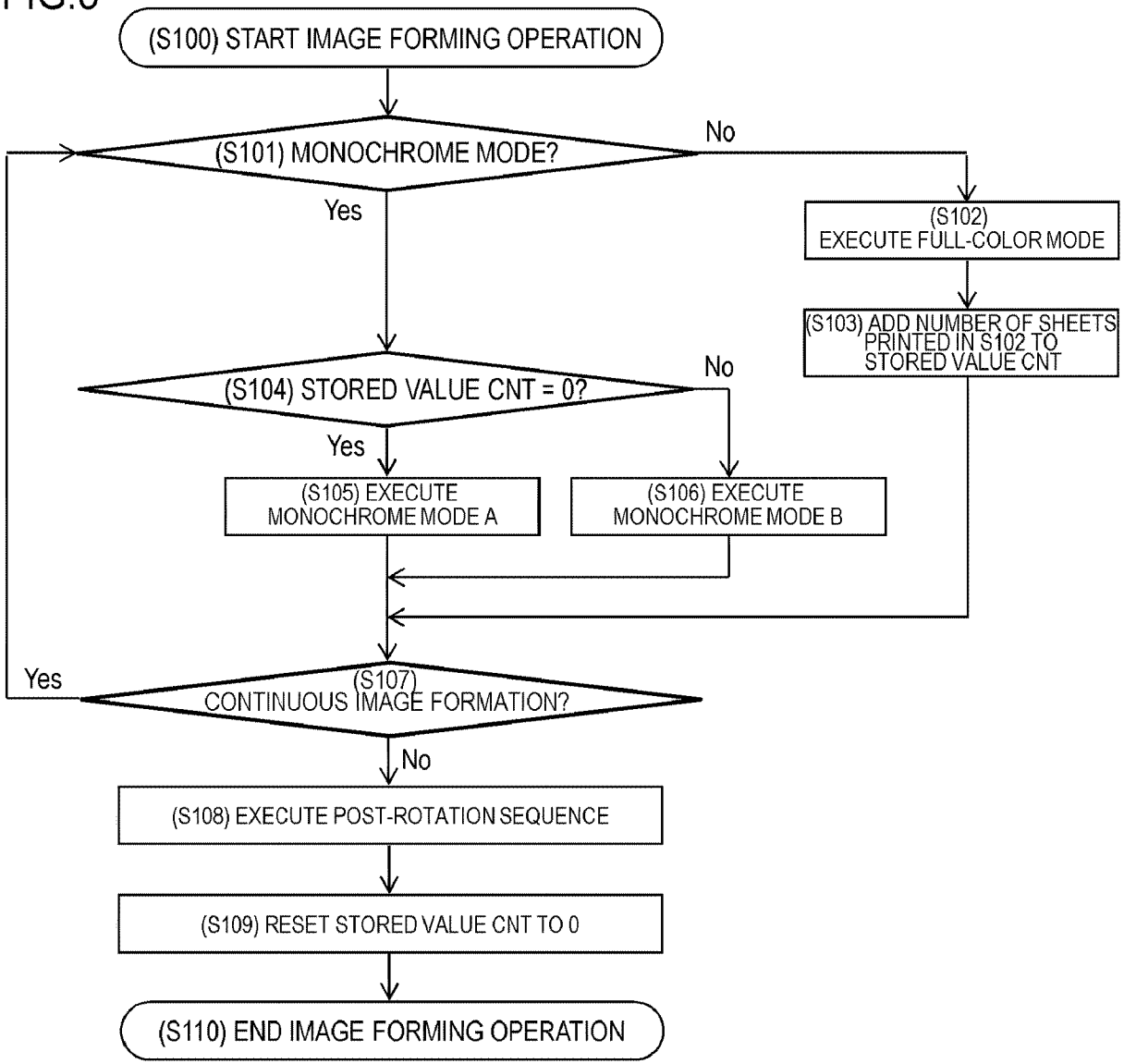
FIG. 3 is a flow chart of an image forming operation according to a first embodiment.
Figure 4A:
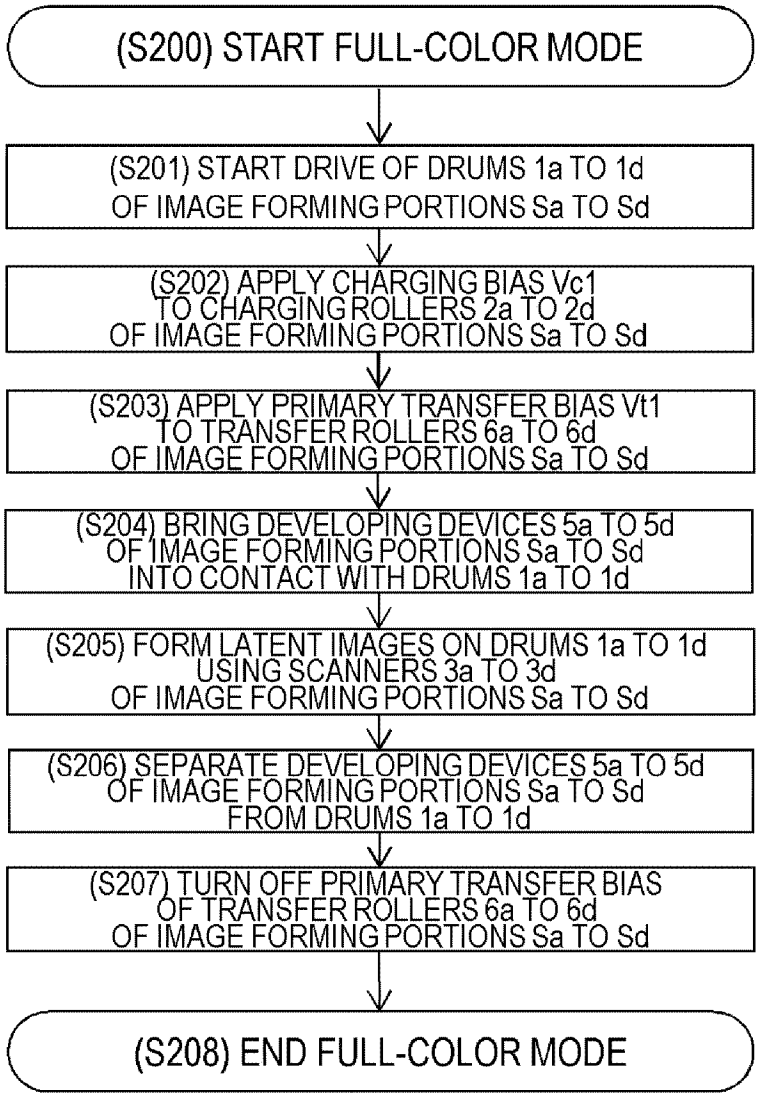
FIGS. 4A and 4B are flow charts of a full-color mode and a post-rotation sequence according to the first embodiment.
Figure 4B:
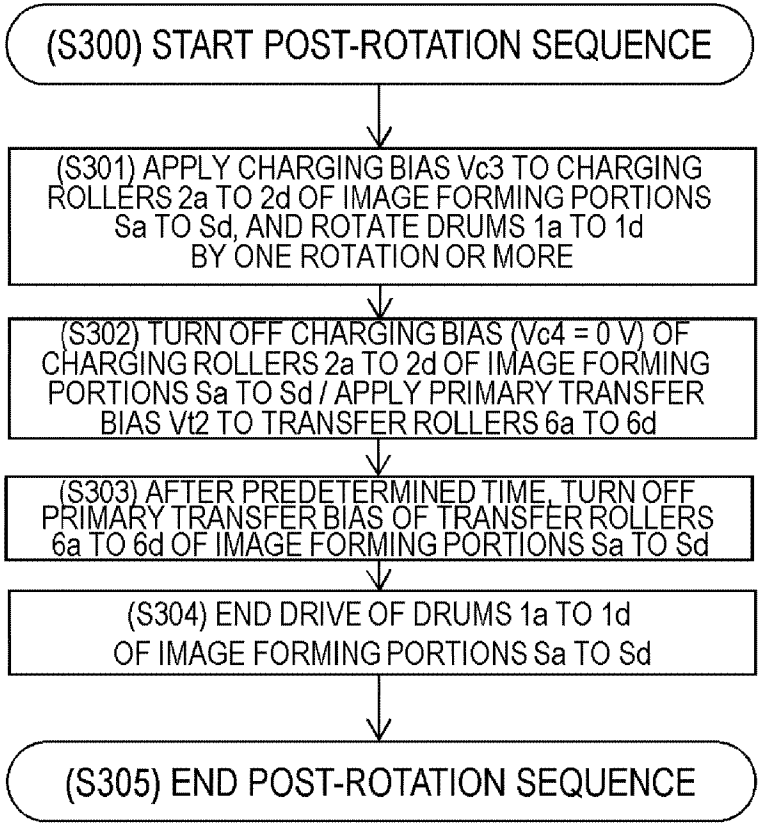
Figure 5:
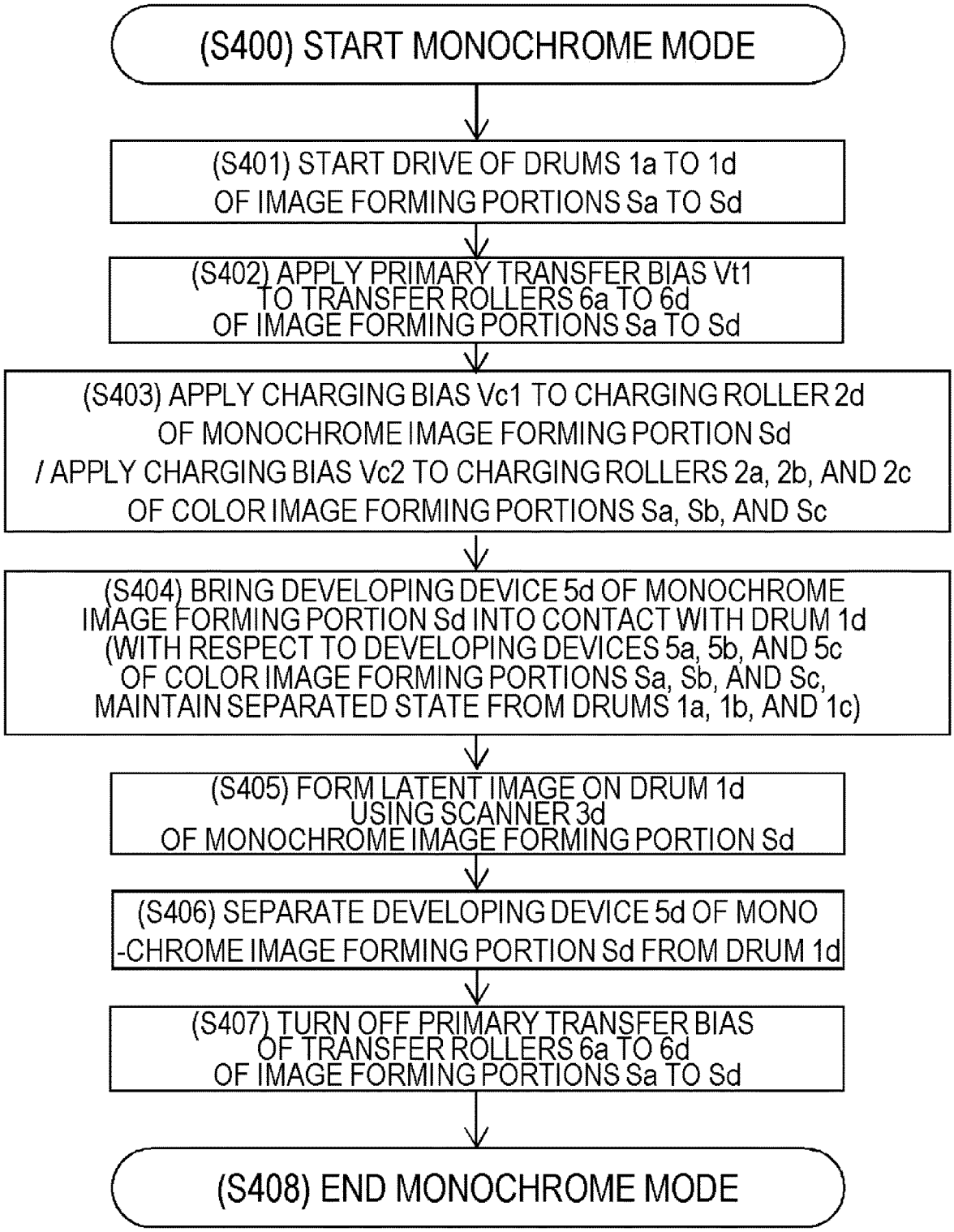
FIG. 5 is a flow chart of a monochrome mode according to the first embodiment.

Next, details of an image forming operation including a monochrome mode according to the present embodiment will be described. FIG. 3 shows a control flow of an entire image forming operation. FIG. 4A shows a flow of the operation during a full-color mode, FIG. 4B shows a flow of the operation during a post-rotation sequence, and FIG. 5 shows a flow of the operation during the monochrome mode. It should be noted that descriptions of the secondary transfer process and the fixing process described above are omitted below.

In the following description, the first, second, and third image forming portions Sa, Sb, and Sc as non-image forming portions which do not perform image formation in the monochrome mode will be called color image forming portions. In addition, the fourth image forming portion Sd which performs image formation in the monochrome mode will be called a monochrome image forming portion.

Control Flow of Entire Image Forming Operation

The control flow of an entire image forming operation will be first described with reference to FIG. 3. When the image forming operation is started (S100), a determination is first made as to whether an image formation mode in a printing process (hereinafter, a print job) to be executed is the monochrome mode or the full-color mode (S101), and when the image formation mode is the full-color mode, the full-color mode is executed (S102). When the full-color mode is executed (S102), the number of sheets printed is added to a stored value CNT that represents a counter of contamination of the charging roller 2 (S103). In the present embodiment, the stored value CNT is stored in a storage portion 102A of the control circuit portion 102.

On the other hand, when the print job to be executed is the monochrome mode, a determination is made as to whether or not a value of the stored value CNT is 0 (S104). When the value of the stored value CNT is 0, a monochrome mode A is executed (S105), but when the value of the stored value CNT is not 0, since the charging roller 2 is conceivably in a state of being contaminated with toner, a monochrome mode B that is a feature of the present disclosure is executed (S106). Control operations of the monochrome mode A and the monochrome mode B differ from one another in set values of a charging bias Vc2 to be described later. Since a same operation is otherwise performed, the use of the term "monochrome mode" in the following description indicates that an operation common to the monochrome mode A and the monochrome mode B is being described.

After executing the respective image formation modes (S103, S105, and S106), a determination is made as to whether or not continuous image formation is to be performed or, in other words, whether or not there is a next print job (S107). When continuous image formation is to be performed, an image formation mode of the next print job is determined once again (S101), and each image formation mode is executed. When it is determined that continuous image formation is not performed, a post-rotation sequence is executed (S108). In the present embodiment, a cleaning process of the charging roller 2 is performed in the post-rotation sequence. Subsequently, once the post-rotation sequence ends, the stored value CNT that represents a counter of contamination of the charging roller 2 is reset to 0 (S109). After the operation described above, the image forming operation is ended (S110).

Control Flow of Full-Color Mode

The control flow in the full-color mode will be described with reference to FIG. 4A. The full-color mode is an image formation mode in which toner images of the respective colors formed on the drums 1*a* to 1*d* of the image forming portions Sa to Sd are sequentially transferred onto the belt 41 so as to overlap with each other to form a toner image made up of a plurality of colors on the belt 41. When the full-color mode is started (S200), first, rotational driving of the drums 1*a* to 1*d* of the image forming portions Sa to Sd is started or continued (S201). Next, a charging bias Vc1 as a first charging bias for image formation is applied to the charging rollers 2*a* to 2*d* of the image forming portions Sa to Sd (S202). Next, the primary transfer bias Vt1 as a first transfer bias is applied to the transfer rollers 6*a* to 6*d* of the image forming portions Sa to Sd (S203). Next, the developing devices 5*a* to 5*d* of the image forming portions Sa to Sd are brought into contact with the drums 1*a* to 1*d* (S204). In the present embodiment, the charging bias Vc1 for image formation is set to −1100 V and the primary transfer bias Vt1 is set to +300 V. Subsequently, latent images are formed on the drums 1*a* to 1*d* by the scanners 3*a* to 3*d* of the image forming portions Sa to Sd for the purpose of image formation (S205). Once image formation is finished, the developing devices 5*a* to 5*d* (the developing rollers 51) of the image forming portions Sa to Sd are separated from the drums 1*a* to 1*d* (S206). Next, the primary transfer bias of the transfer rollers 6*a* to 6*d* of the image forming portions Sa to Sd is turned off (S207). After the operation described above, the full-color mode is ended (S208).

In this case, after the developing device 5 (the developing roller 51) is separated from the drum 1, the primary transfer bias is turned off after a portion with which the developing device 5 had been in contact on the surface of the drum 1 passes the primary transfer position N1. Accordingly, even when toner charged to a negative polarity due to contact by the developing device 5 adheres to the drum 1, the toner can be transferred onto the belt 41. Therefore, a transition can be made to a next operation control in a state where toner charged to a negative polarity is removed from the surface of the drum 1.

Control Flow of Post-Rotation Sequence

A control flow in the post-rotation sequence in which a cleaning process of the charging roller 2 is performed will be described with reference to FIG. 4B. When the post-rotation sequence is started (S300), first, the drums 1*a* to 1*d* are rotated and charged to a predetermined potential in a state where a charging bias Vc3 is applied to the charging rollers 2*a* to 2*d* of the image forming portions Sa to Sd (S301). A rotation distance in this case is desirably equal to or exceeds one rotation of the drums so that the cleaning process of the charging roller 2 can be performed by utilizing an entire circumference of the drum. Next, the charging bias of the charging rollers 2*a* to 2*d* of the image forming portions Sa to Sd is turned off, and the primary transfer bias Vt2 is applied to the transfer rollers 6*a* to 6*d* (S302). In the present embodiment, the charging bias Vc3 is set to −1100 V and the primary transfer bias Vt2 is set to −1000 V. After rotationally driving the drums 1*a* to 1*d* for a predetermined time in order to clean the charging rollers 2*a* to 2*d*, the primary transfer bias of the transfer rollers 6*a* to 6*d* of the image forming portions Sa to Sd is turned off (S303). Subsequently, the rotational driving of the drums 1*a* to 1*d* of the image forming portions Sa to Sd is finished (S304). After the operation described above, the post-rotation sequence is ended (S305).

Control Flow of Monochrome Mode

The control flow in the monochrome mode will be described with reference to FIG. 5. When the monochrome mode is started (S400), first, rotational driving of the drums 1*a* to 1*d* of the image forming portions Sa to Sd is started or continued (S401). Next, the primary transfer bias Vt1 is applied to the transfer rollers 6*a* to 6*d* of the image forming portions Sa to Sd (S402). Next, the charging bias Vc1 for image formation is applied to the charging roller 2*d* of the monochrome image forming portion Sd. The charging bias Vc2 to be described later is applied to the charging rollers 2*a*, 2*b*, and 2*c* of the color image forming portions Sa, Sb, and Sc (S403). Next, the developing device 5*d* (the developing roller 51*d*) of the monochrome image forming portion Sd is brought into contact with the drum 1*d*. In addition, the developing devices 5*a*, 5*b*, and 5*c* of the color image forming portions Sa, Sb, and Sc are maintained in a separated state from the drums 1*a*, 1*b*, and 1*c* (S404). By separating the developing devices 5*a*, 5*b*, and 5*c* not used for image formation in this manner, toner is prevented from being developed on the drums 1*a*, 1*b*, and 1*c* when setting the charging bias Vc2 lower than the charging bias Vc1 during image formation. Subsequently, a latent image is formed on the drum 1*d* by the scanner 3*d* of the monochrome image forming portion Sd for the purpose of image formation (S405). Once image formation is finished, the developing device 5*d* of the monochrome image forming portion Sd is separated from the drum 1*d* (S406). Next, the primary transfer bias of the transfer rollers 6*a* to 6*d* of the image forming portions Sa to Sd is turned off (S407). After the operation described above, the monochrome mode is ended (S408).

While the primary transfer bias is turned off before the end of the full-color mode and the end of the monochrome mode in the present embodiment, alternatively, the primary transfer bias may be continuously applied until the next image formation mode or the post-rotation sequence.

Charging Bias During Execution of Monochrome Mode

In the control of the monochrome mode described above, the charging bias is turned off (Vc2=0 V) when the monochrome mode A as a first monochrome image formation mode is being executed. In addition, when the monochrome mode B as a second monochrome image formation mode is being executed, the charging bias Vc2 as a second charging bias is set to a voltage which has a same polarity (a negative polarity) as the charging bias Vc1 for image formation and which is equal to or lower than a discharge start voltage Vth. In the present embodiment, the charging bias Vc2 during execution of the monochrome mode B is set to −450 V.

The discharge start voltage Vth that is necessary for setting the charging bias Vc2 will now be described with reference to FIG. 6. For the sake of description, a surface potential of the drum 1 on an upstream side in a rotation direction of the drum 1 in a vicinity of a contact position (hereinafter, a charging position) of the charging roller 2 (in other words, the surface potential of the drum 1 prior to being charged by the charging roller 2) will be referred to as a charge upstream drum potential Vd1. In addition, a surface potential of the drum 1 on a downstream side in the rotation direction of the drum 1 in the vicinity of the charging position (in other words, the surface potential of the drum 1 after being charged by the charging roller 2) will be referred to as a charge downstream drum potential Vd2. Furthermore, respective potential differences ΔV1, ΔV2, and ΔVd among the charging bias Vc, the charge upstream drum potential Vd1, and the charge downstream drum potential Vd2 are to be expressed as in Equation 1, Equation 2, and Equation 3.

$$\Delta V1=-(Vc-Vd1) \quad \text{Equation 1}$$

$$\Delta V2=-(Vc-Vd2) \quad \text{Equation 2}$$

$$\Delta Vd=-(Vd2-Vd1) \quad \text{Equation 3}$$

Figure 6:
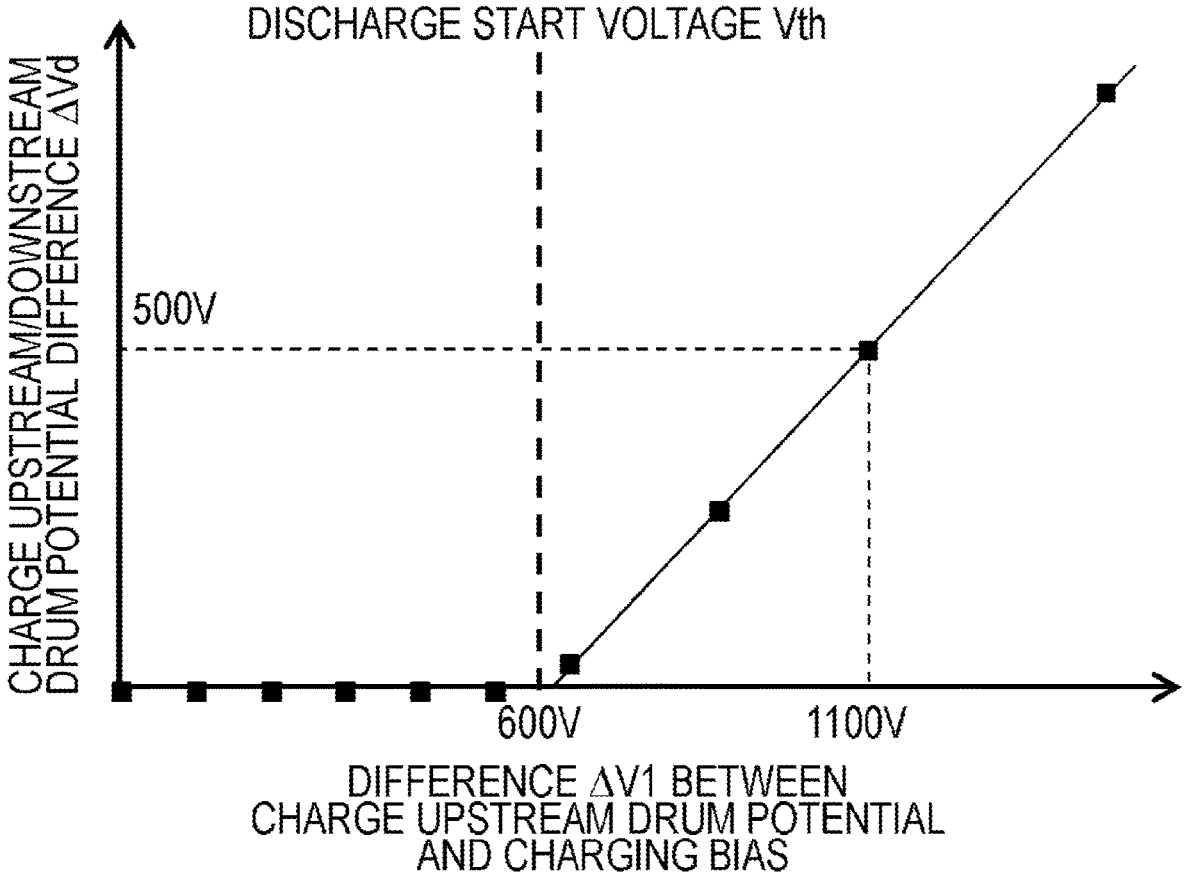
FIG. 6 is a potential relationship diagram showing a discharge start voltage Vth.

FIG. 6 shows a relationship between the potential difference ΔV1 between the charge upstream drum potential Vd1 and the charging bias Vc and the potential difference ΔVd between the charge upstream drum potential Vd1 and the charge downstream drum potential Vd2. Plots in FIG. 6 represent measurement points where a potential was measured using the surface potentiometer Model 344 manufactured by TREK JAPAN in the image forming apparatus according to the present embodiment. The relationship between the potential differences in FIG. 6 can also be described a relationship between an absolute value of the charging bias Vc and an absolute value of a drum potential after charge or, in other words, an absolute value of the charge downstream drum potential Vd2 when the drum potential prior to charge or, in other words, the charge upstream drum potential Vd1 is 0 V.

As shown in FIG. 6, in a contact charging system, since discharge from the charging roller 2 to the drum 1 does not occur when the potential difference ΔV1 is small, a potential change ΔVd at the charging position of the drum 1 is virtually nonexistent. When the potential difference ΔV1 increases, discharge from the charging roller 2 to the drum 1 starts at a certain value. This value is the discharge start voltage Vth. In addition, when the potential difference ΔV1 equals or exceeds the discharge start voltage Vth (becomes larger than the discharge start voltage Vth), the potential change ΔVd of the drum 1 enters a proportional relationship with the potential difference ΔV1. As a result, the drum 1 is charged so that the charge downstream drum potential Vd2 of the drum 1 equals a potential of which the polarity is the same as the charging bias Vc and of which the absolute value is obtained by subtracting the discharge start voltage Vth from the absolute value of the charging bias Vc.

As described above, when applying a charging bias Vc that causes the potential difference ΔV1 to be equal to or lower than the discharge start voltage Vth, discharge from the charging roller 2 to the drum 1 does not occur. Therefore, when setting the charging bias Vc, a simple method of suppressing discharge at the charging position without depending on the charge upstream drum potential Vd1 that determines the potential difference ΔV1 involves setting the charging bias Vc as follows. In consideration of a timing at which the charge upstream drum potential Vd1 becomes 0 V, the absolute value of the charging bias Vc may be set to a value equal to or smaller than the discharge start voltage Vth.

The discharge start voltage Vth is a value determined by various conditions such as the charging roller 2 and the drum 1, use environment, and use history. In the conditions used in the present embodiment, the discharge start voltage Vth is 600 V. Therefore, the charge downstream drum potential Vd2 when the charging bias Vc is the charging bias Vc1 for image formation (−1100 V) is −500 V. In addition, when the charging bias Vc is the charging bias Vc2 (0 V or −450 V) of which the absolute value is set equal to or smaller than the discharge start voltage Vth (600 V), discharge does not occur and there is no potential change of the drum 1 at the charging position (Vd1=Vd2). In other words, the charging bias Vc2 that does not generate discharge due to being set equal to or lower than the discharge start voltage Vth is respectively applied to the color image forming portions Sa, Sb, and Sc when a monochrome mode is being executed.

Figure 7A:
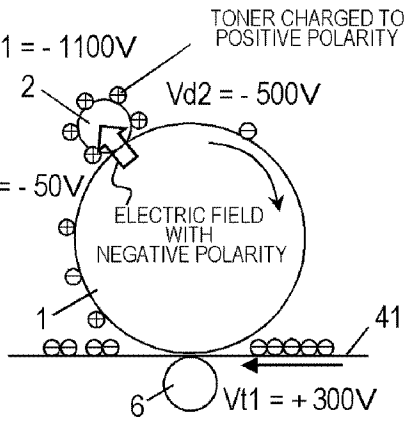
FIGS. 7A to 7D are schematic views showing movements of toner according to the first embodiment and a first comparative example.
Figure 7B:
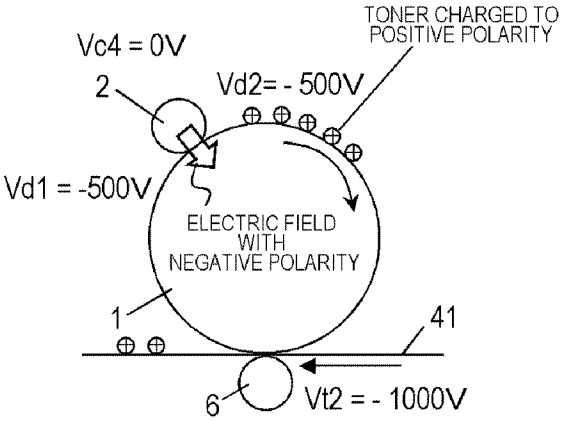
Figure 7C:
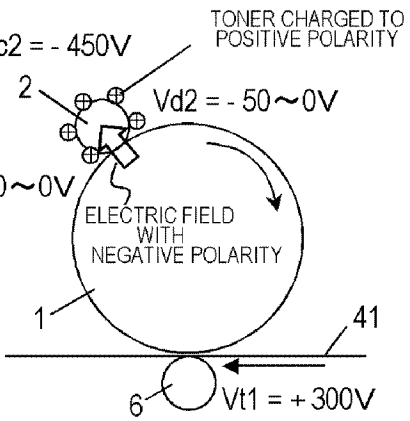

Movement of Toner in Color Image Forming Portion During Execution of Respective Controls Movement of toner in color image forming portions during the execution of the respective controls including the monochrome mode B that is a feature of the present embodiment will be described with reference to FIGS. 7A to 7C. FIGS. 7A, 7B, and 7C are schematic views showing movement of toner in the color image forming portions Sb and Sc when the respective controls (the full-color mode, the post-rotation sequence, and the monochrome mode B) according to the first embodiment are being executed. The movement of toner in the second and third image forming portions Sb and Sc among the color image forming portions will be described below and the suffixes b (magenta) and c (cyan) will be omitted.

(1) Movement of Toner During Execution of Full-Color Mode

As shown in FIG. 7A, in the color image forming portions Sb and Sc when the full-color mode is being executed, the charging bias Vc1 (−1100 V) with a negative polarity is applied to the charging roller 2 and the drum 1 is charged so that the charge downstream drum potential Vd2 is −500 V. The primary transfer bias Vt (+300 V) with a positive polarity is applied to the primary transfer roller 6 in order to transfer toner having been charged to a negative polarity. Therefore, a current flows between the primary transfer roller 6 and the drum 1 and the charge upstream drum potential Vd1 of the drum 1 has dropped to −50 V. Therefore, the potential difference ΔV1 at a charge upstream position becomes 1050 V and the potential difference ΔV2 at a charge downstream position becomes 600 V, which are both positive values. Therefore, an electric field with a negative polarity acts from the drum 1 toward the charging roller 2 in a vicinity of the charging position.

A toner image of a given color developed on the drum 1 from the developing device 5 and a toner image of another color transferred to the belt 41 from another image forming portion present on the upstream side in the movement direction of the belt 41 pass through the primary transfer position N1. Among the toners that form these toner images, there is more than a small amount of untransferred toner that remains on the drum 1 or moves without being transferred to the belt 41. In such untransferred toner, untransferred toner charged to a polarity (a positive polarity) that is opposite to the normal charging polarity of the toner is likely to adhere to the charging roller 2 due to the electric field described above which has a negative polarity from the drum 1 toward the charging roller 2. Therefore, when executing the full-color mode, the charging roller 2 becomes contaminated with toner charged to a positive polarity.

When such toner contamination of the charging roller 2 accumulates, the drum 1 can no longer be charged to a desired potential and image defects such as background fogging occur. Therefore, in the present embodiment, a cleaning process of the charging roller 2 is performed in the post-rotation sequence or the like. In addition, the number of sheets printed in the full-color mode is stored in the stored value CNT that represents a counter of contamination of the charging roller 2 and the stored value CNT is used for control determination of the charging bias Vc2 in the monochrome mode as described above.

(2) Movement of Toner During Execution of Post-Rotation Sequence (Cleaning Process of Charging Roller)

As shown in FIG. 7B, respective biases are controlled as follows in the color image forming portions Sb and Sc during the execution of the post-rotation sequence (the cleaning process of the charging roller 2). Specifically, the primary transfer bias Vt2 with a negative polarity is applied to the primary transfer roller 6, and the charging bias applied to the charging roller 2 causes the drum 1 to be charged to a predetermined potential (Vd2=−500 V) and is then turned off (Vc4=0 V). As a result, the potential difference ΔV1 and the potential difference ΔV2 in the vicinity of the charging position take a negative value (−500 V). In other words, an electric field with a negative polarity acts from the charging roller 2 toward the drum 1. Accordingly, contaminated toner which adheres to the charging roller 2 and which is charged to a positive polarity is ejected onto the drum 1. In addition, the ejected contaminated toner is transferred to the belt 41 by the primary transfer bias Vt2 (−1000 V) with a negative polarity at the primary transfer position N1. Subsequently, the contaminated toner is removed and recovered by the belt cleaning apparatus 80 without being moved by the primary transfer bias Vt2 (−1000 V) with a negative polarity to the drum 1 of image forming portions on a downstream side of the movement direction of the belt 41.

The toner contamination of the charging roller 2 tends to be caused by toner of a color of an image forming portion on the upstream side in the movement direction of the belt 41 that differs from the color of the image forming portion of the charging roller 2. Therefore, in the present embodiment, during the cleaning process of the charging roller 2, color mixing in the developing device 5 of the color of the charging roller 2 is suppressed by recovering contaminated toner to the belt cleaning apparatus 80 instead of the developing device 5.

While a charging bias Vc4 during the cleaning process of the charging roller 2 is set to 0 V in this case, the charging bias Vc4 need not necessarily be 0 V. The charging bias Vc4 need only be a lower charging bias than the surface potential (Vd1=600 V) of the drum 1 having been charged by the charging bias Vc3 (−1100 V) so that an electric field with a negative polarity is formed from the charging roller 2 toward the side of the drum 1.

(3) Movement of Toner During Execution of Monochrome Mode

The monochrome mode A is executed when the stored value CNT that represents a counter of contamination of the charging roller 2 has been reset and is 0. Therefore, when the monochrome mode A is being executed, the charging roller 2 is in a state where contaminated toner has been cleaned by the cleaning process. In other words, during a period from start of image formation to end of continuous image formation after execution of the post-rotation sequence (after the cleaning process has been performed), when a monochrome mode is repeated without performing the full-color mode, the monochrome mode is the monochrome mode A. Therefore, a potential relationship between the charging roller 2 and the drum 1 need not be appropriately set so as to prevent the contaminated toner from being ejected to the drum 1. In the present embodiment, the charging bias Vc2 during the monochrome mode A is turned off in order to prevent deterioration of the drum 1 and, at the same time, avoid unnecessary power consumption.

On the other hand, when the monochrome mode B is being executed, the full-color mode has already been executed and there is contaminated toner adhering to the charging roller 2. Therefore, a potential relationship between the charging roller 2 and the drum 1 is appropriately set so as to prevent the contaminated toner from being ejected to the drum 1.

Specifically, as shown in FIG. 7C, respective biases are controlled as follows in the color image forming portions Sb and Sc when the monochrome mode B is being executed. More specifically, the primary transfer bias Vt1 (+300 V) with a positive polarity is applied to the primary transfer roller 6 and, at the same time, the charging bias Vc2 (−450 V) that is equal to or lower than the discharge start voltage Vth is applied to the charging roller 2. At this point, the charge upstream drum potential Vd1 of the drum 1 has dropped to −50 V to 0 V. In addition, discharge from the charging roller 2 to the drum 1 does not occur, and the charge downstream drum potential Vd2 has also dropped to −50 V to 0 V. As a result, the potential difference ΔV1 and the potential difference ΔV2 in the vicinity of the charging position take a positive value (400 V to 450 V). Accordingly, an electric field with a negative polarity is caused to act from the drum 1 toward the charging roller 2 and contaminated toner which adheres to the charging roller 2 and which is charged to a positive polarity is retained on the charging roller 2. In order to effectively retain the contaminated toner, the charging bias Vc2 is preferably set so that the potential difference ΔV1 and the potential difference ΔV2 in the vicinity of the charging position are 100 V or higher.

It should be noted that the charging bias Vc2 in the monochrome mode A need not be turned off in order to obtain the effect of the present disclosure and, even in the monochrome mode A, the charging bias Vc2 may be set equal to or lower than the discharge start voltage Vth in a similar manner to the monochrome mode B. However, a configuration in which the charging bias Vc2 that is equal to or lower than the discharge start voltage Vth is only turned on when switching from the full-color mode to a monochrome mode (the monochrome mode B) as in the present embodiment is more favorable. Adopting such a configuration enables unnecessary power consumption to be reduced while suppressing ejection of contaminated toner from the charging roller 2.

Figure 8:
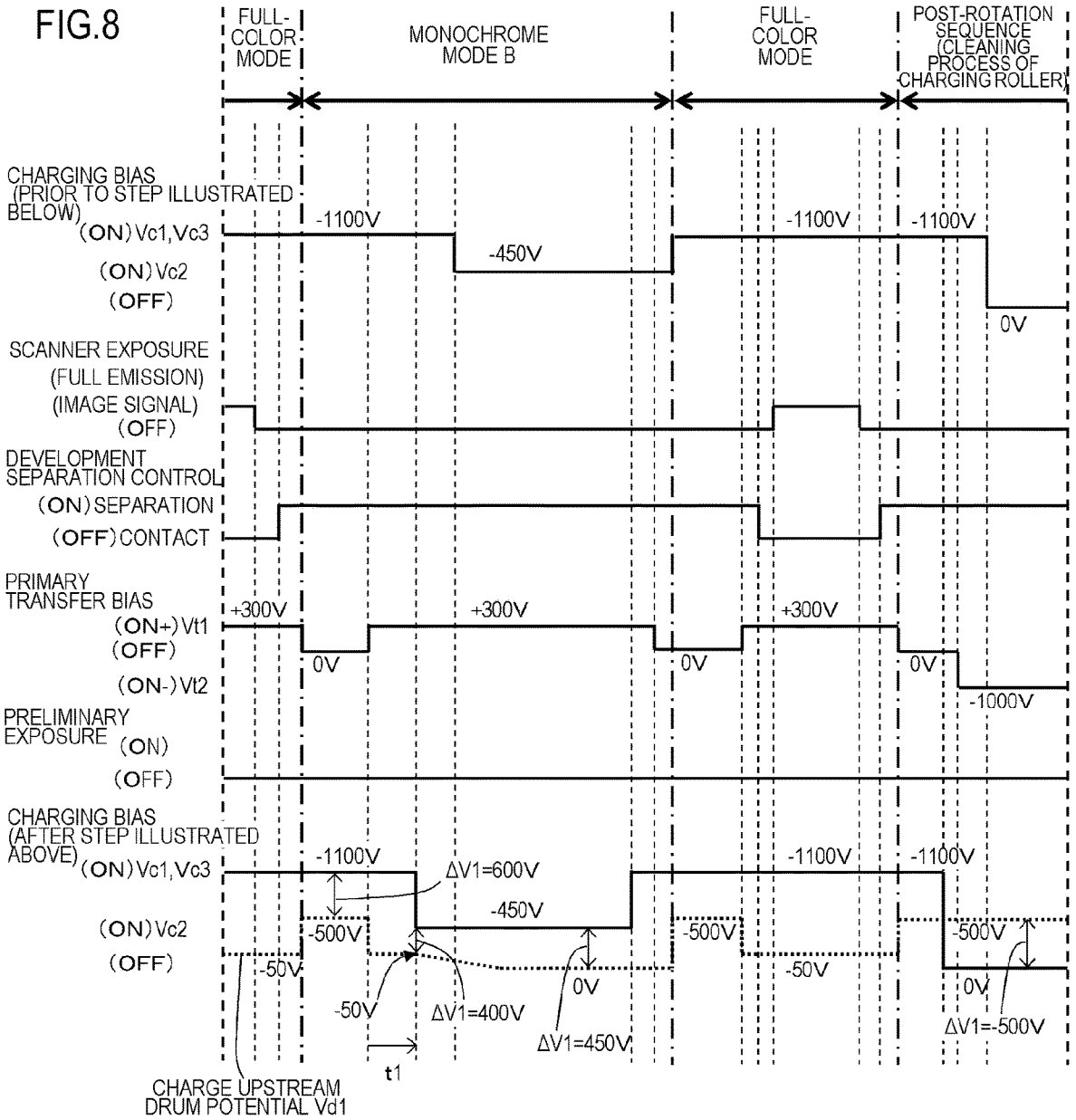
FIG. 8 is a timing chart during image formation including a monochrome mode B according to the first embodiment.

A potential relationship between the charging roller 2 and the drum 1 which contributes to the movement of toner will be described in chronological order with reference to FIG. 8. FIG. 8 is a timing chart during image formation including the monochrome mode B in the color image forming portions Sb and Sc according to the first embodiment. In addition, a potential relationship between the charge upstream drum potential Vd1 and the charging bias Vc at respective timings is shown in FIG. 8.

A way to view the timing chart will be described below. Controls of steps along a rotation direction of the drum 1 are sequentially shown from the top of the diagram, in which an abscissa of each step represents a time axis. Time flows in a direction from left to right, and a line moves upward or downward when a signal or a bias is applied. In the case of bias control, a magnitude of voltage is represented by height and a voltage value is written in a movement portion of the line. Positions having same abscissas in a vertical direction represent a same position on the drum 1 reflecting previous and subsequent steps due to the rotation of the drum 1 and, in terms of time, the positions are shifted precisely by a movement time between steps. For example, with respect to charging bias control shown in a lower part of the diagram, charging bias control shown in an upper part of the diagram is charging bias control that had been applied one rotation before of the drum. In addition, the charge upstream drum potential Vd1 at a timing of the charging bias control shown in the lower part of the diagram is indicated by a dotted time.

FIG. 8 represents control when, after the full-color mode, the monochrome mode B is performed due to the presence of successive print jobs in the monochrome mode, and after once again performing the full-color mode, the post-rotation sequence is performed. Since the charging bias Vc1 (−1100 V) is still being applied at the start of the monochrome mode B, the surface potential of the drum 1 is charged to −500 V and the potential difference ΔV1 at a charge upstream position is 600 V. Subsequently, when the primary transfer bias Vt1 (+300 V) is applied, a current flows between the primary transfer roller 6 and the drum 1, the charge upstream drum potential Vd1 drops to −50 V, and the potential difference ΔV1 at the charge upstream position changes to 1050 V. Therefore, at the start of switching to the charging bias Vc2 (−450 V), the charge upstream drum potential Vd1 is −50 V and the potential difference ΔV1 at the charge upstream position is 400 V. In addition, since discharge stops at the charging position, the potential difference ΔV2 at a charge downstream position is also 400 V.

As shown in FIG. 8, a time t1 denotes a time from a timing when application of the transfer bias Vt1 is started and the surface of the drum 1 of which the surface potential has dropped to lower than the charging bias Vc2 (−450 V) reaches the charging roller 2 to a timing when application of the charging bias Vc2 is started. The time t1 is set to a predetermined time such that, in order to suppress ejection of contaminated toner, the surface potential Vd1 of the drum 1 is lowered and the potential difference ΔV1 is increased prior to the application of the charging bias Vc2.

The drum 1 has a property that surface potential thereof declines with time even at a dark location where the drum 1 is not exposed to light. In addition, in order to prevent discharge at the charging position, the surface potential of the drum 1 is reduced by the primary transfer bias every time the drum 1 makes one rotation. Furthermore, the charge upstream drum potential Vd1 drops to near 0 V. At this point, the potential difference ΔV1 and the potential difference ΔV2 in the vicinity of the charging position are 450 V. When the charging bias Vt1 (−1100 V) of the next full-color mode is applied, the potential difference ΔV1 at the charge upstream position becomes 1100 V.

Therefore, during the execution of the monochrome mode B, the potential difference ΔV1 and the potential difference ΔV2 having positive values and being oriented so as retain the contaminated toner on the charging roller 2 are formed and maintained. In addition, since the potential difference ΔV1 and the potential difference ΔV2 having positive values are also formed and maintained when the next successive full-color mode is being executed, the contaminated toner can be retained on the charging roller 2 and image defects due to ejection of the contaminated toner can be suppressed.

First Comparative Example

An image forming operation including a monochrome mode according to a first comparative example (a conventional example) will be described. Since a configuration of an image forming apparatus does not differ from that in the first embodiment, a description thereof will be omitted below. In the first comparative example, unlike in the first embodiment, the charging bias Vc is not applied in the color image forming portions Sa, Sb, and Sc when a monochrome mode is being executed. In comparison to the monochrome mode B according to the first embodiment, this is comparable to turning off the charging bias Vc2 (Vc2=0 V) in a similar manner to the monochrome mode A.

Second Comparative Example

An image forming operation including a monochrome mode according to a second comparative example (a conventional example) will be described. Since a configuration of an image forming apparatus does not differ from that in the first embodiment, a description thereof will be omitted below. In the second comparative example, unlike in the first embodiment, the charging bias Vc is set to the normal charging bias Vc1 (−1100 V) during image formation in the color image forming portions Sa, Sb, and Sc when a monochrome mode is being executed. In other words, a charging bias exceeding the discharge start voltage Vth is being applied. In comparison to the monochrome mode B according to the first embodiment, this is comparable to setting the charging bias Vc2 (Vc2=−1100 V) the same as the charging bias Vc1 for image formation.

Figure 7D:
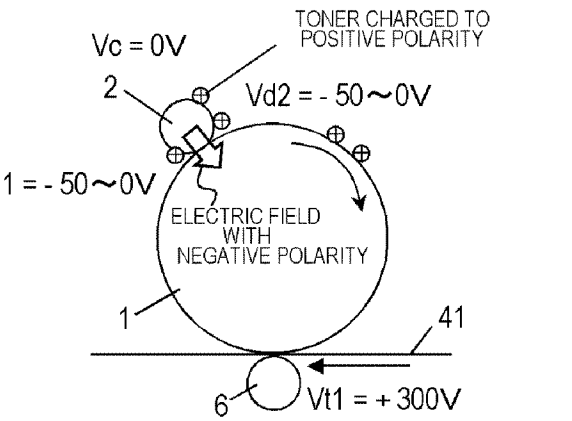

Comparison Among First Embodiment, First Comparative Example, and Second Comparative Example A comparison among cases where an image forming operation including the monochrome mode B are performed in the first embodiment, the first comparative example, and the second comparative example will be performed. FIG. 7D is a schematic view showing movement of toner in the color image forming portions Sb and Sc when the monochrome mode according to the first comparative example is being executed. The suffixes b (magenta) and c (cyan) will be omitted below. In the first embodiment and the first comparative example, the charge upstream drum potential Vd1 when the monochrome mode is being executed is either a potential having a magnitude on a side of negative polarity or a potential near 0 V. Therefore, when the charging bias Vc is not applied as in the first comparative example, a potential relationship exists in which the potential difference ΔV1 and the potential difference ΔV2 in the vicinity of the charging position have a negative value or have a value in the vicinity of zero.

As shown in FIG. 7D, the charge upstream drum potential Vd1 when the monochrome mode according to the first comparative example is being executed is initially −50 V and subsequently drops to 0 V in a similar manner to the first embodiment. In addition, since the charging bias is equal to or lower than the discharge start voltage Vth and prevents an occurrence of discharge from the charging roller 2 to the drum 1, the charge downstream drum potential Vd2 is also initially −50 V but subsequently drops to 0 V. As a result, the potential difference ΔV1 and the potential difference ΔV2 in the vicinity of the charging position take a negative value (−50 V to 0 V). In such a potential relationship, contaminated toner which adheres to the charging roller 2 and which is charged to a positive polarity is moved onto the drum 1. In addition, at this point, a non-uniformity may be created in an amount of ejected toner due to surface potential non-uniformity or the like of the drum 1 and may cause a non-uniformity in an amount by which the contaminated toner adheres to the charging roller 2. Furthermore, since potentials of the charging roller 2 and drum 1 become closer to each other, contaminated toner once ejected onto the drum 1 may be recovered once again by the charging roller 2 as the drum 1 rotates. Moreover, at this point, the non-uniformity in an amount by which the contaminated toner adheres onto the drum 1 may worsen as the drum 1 rotates before the contaminated toner is ejected onto the drum 1 and recovered once again by the charging roller 2. As a result, a non-uniformity (a toner contamination non-uniformity) in an amount by which the contaminated toner adheres to the charging roller 2 is created. Accordingly, uniform charging can no longer be performed by the charging roller 2 during image formation, and image defects such as a non-uniform density image in a printed portion and background fogging in a non-printed portion may occur.

On the other hand, since the charging bias Vc2 when the monochrome mode B is being executed is set to the side of negative polarity in the first embodiment, a potential relationship is realized in which the charging bias Vc2 is larger on the side of negative polarity than the charge upstream drum potential Vd1 as described above. As a result, contaminated toner which adheres to the charging rollers 2*b* and 2*c* and which is charged to a positive polarity can be retained on the charging rollers 2*b* and 2*c* without being ejected onto the drums 1*b* and 1*c*. Accordingly, compared to the first comparative example, image defects such as a non-uniform density image and a change in tinge due to the contaminated toner being ejected onto the drums 1*b* and 1*c* can be suppressed.

In addition, conceivable control methods for suppressing an occurrence of image defects of the color image forming portions Sb and Sc according to the first comparative example as described above include the following control method. The control method involves, when contaminated toner is ejected to the drums 1*b* and 1*c* when a monochrome mode is being executed, setting the primary transfer bias of the color image forming portions Sb and Sc to a reverse polarity (a negative polarity) with respect to during image formation in order to prevent the contaminated toner from being recovered once again by the charging rollers 2*b* and 2*c*. In this case, since the contaminated toner with a positive polarity is transferred onto the belt 41 and the contaminated toner is to be recovered by the monochrome image forming portion Sd on a downstream side in the movement direction of the belt 41, the following problems occur. In the monochrome image forming portion Sd during an image forming operation, the charging bias Vc1 (−1100 V) and the primary transfer bias Vt1 (+300 V) are applied and a surface potential difference between the charging roller 2*d* and the drum 1*d* becomes oriented so as to cause the contaminated toner to be recovered by the charging roller 2*d*. Therefore, a toner contamination non-uniformity is generated on the charging roller 2*d* in a similar manner to the color image forming portions Sb and Sc described earlier. In addition, color mixing of contaminated toner of a color that differs from black may occur inside the developing device 53*d* of the monochrome image forming portion Sd and a tinge of an image may change. The present embodiment is also favorable with respect to such problems. Specifically, by suppressing ejection of contaminated toner to the drums 1*b* and 1*c* as in the present embodiment, an image forming apparatus can be provided which is capable of suppressing image defects such as a non-uniform density image and a change in tinge of the monochrome image forming portion Sd in addition to the color image forming portions Sb and Sc.

In the second comparative example, since the charging bias Vc when a monochrome mode is being executed is set to the side of negative polarity in a similar manner to the first embodiment, a potential relationship is realized in which the charging bias Vc is larger on the side of negative polarity than the charge upstream drum potential Vc1. Therefore, image defects such as a non-uniform density image and a change in tinge due to the contaminated toner charged to a positive polarity being ejected onto the drums 1*b* and 1*c* can be suppressed. However, unlike in the first embodiment, in the second comparative example, discharge from the charging rollers 2*a*, 2*b*, and 2*c* to the drums 1*a*, 1*b*, and 1*c* takes place in a similar manner to during the fill-color mode even in the color image forming portions Sa, Sb, and Sc which do not perform image formation. Therefore, deterioration of the drums 1*a*, 1*b*, and 1*c* in the form of abrasion, adhesion of discharge products, or the like is promoted.

Conversely, in the first embodiment, the charging bias Vc2 when the monochrome mode B is being executed is set equal to or lower than the discharge start voltage Vth at which discharge does not take place due to the potential relationship between the charging rollers 2*a*, 2*b*, and 2*c* to the drums 1*a*, 1*b*, and 1*c*. Therefore, compared to the second comparative example, deterioration of the drums 1*a*, 1*b*, and 1*c* can be suppressed. As a result, replacement lives of the process cartridges 8*a*, 8*b*, and 8*c* including the drums 1*a*, 1*b*, and 1*c* can be extended as compared to the second comparative example.

Therefore, although both the suppression of ejection of contaminated toner of the charging rollers 2*b* and 2*c* in the color image forming portions Sb and Sc and the suppression of deterioration of the drums 1*a*, 1*b*, and 1*c* cannot be achieved in the first comparative example and the second comparative example, the first embodiment is capable of achieving both of these objectives.

In addition, in the first embodiment, since the cleaning process of the charging roller 2 can be omitted during a transition from the full-color mode to the monochrome mode B, a wait time of the user can be shortened.

Furthermore, in the present embodiment, the cleaning process of the charging roller 2 is performed after a print job is finished. Accordingly, the wait time of the user can be shortened while suppressing image defects such as background fogging due to the adhesion and accumulation of toner to the charging roller 2 during the full-color mode.

In addition, since problems in an image bearing member cleaner-less system in which the drum 1 is not provided with a dedicated cleaning apparatus as described above are addressed, a small image forming apparatus can be provided.

As described above, according to the present embodiment, the following effects can be obtained when there is an image forming portion that does not perform image formation during a monochrome mode or the like among image forming portions S arranged in plurality. Specifically, the present embodiment enables the wait time of the user to be shortened and, in the image forming portions Sb and Sc that do not perform image formation, a non-uniform density image and the like due to the ejection of toner adhered to the charging rollers 2*b* and 2*c* to be suppressed while suppressing deterioration of the drum 1.

In the present embodiment, operations of the first to third image forming portions Sa, Sb, and Sc as color image forming portions and bias setting values to be applied thereto are the same. However, configurations for obtaining the effects of the present disclosure are not limited to the configuration described above. For example, a configuration may be adopted in which the bias setting values described above are applied in at least one image forming portion of the second image forming portion Sb and the third image forming portion Sc. In other words, controls of the present disclosure need only be adopted in image forming portions that are: on an upstream side in the movement direction of the belt 41 with respect to the fourth image forming portion Sd which performs image formation when a monochrome mode is being executed; on a downstream side of the secondary transfer position N2; and excluding the first image forming portion Sa that is most upstream.

Second Embodiment

Figure 9:
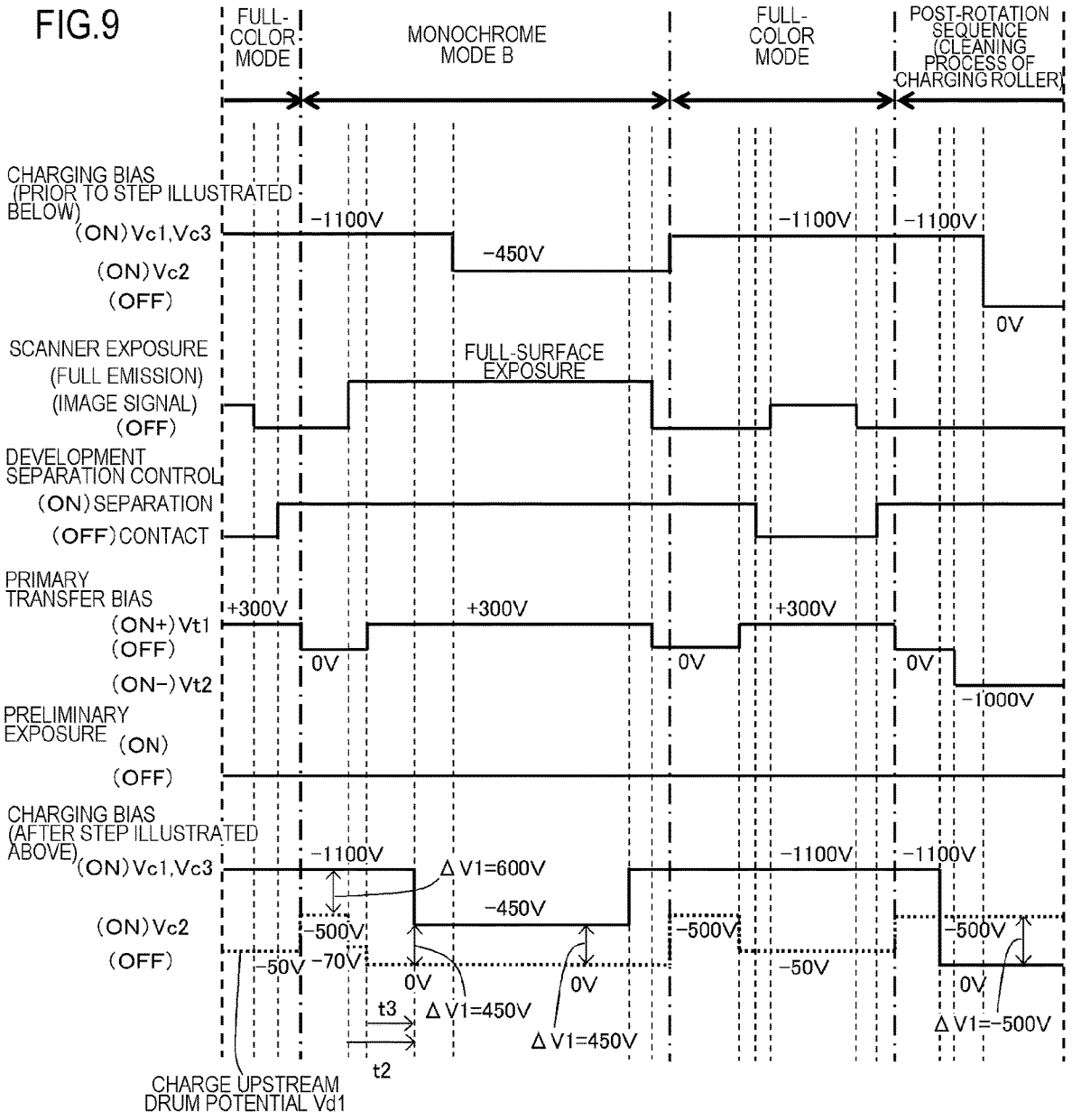
FIG. 9 is a timing chart during image formation including a monochrome mode B according to a second embodiment.

An image forming apparatus according to a second embodiment of the present disclosure will be described with reference to FIG. 9. Since an apparatus configuration of the image forming apparatus according to the second embodiment does not differ from the apparatus configuration of the image forming apparatus according to the first embodiment, a description thereof will be omitted below. A potential relationship between the charging roller 2 and the drum 1 which contributes to movement of toner will be described with reference to FIG. 9 while comparing control operations in chronological order with those of the first embodiment. FIG. 9 is a timing chart during image formation including the monochrome mode B in the color image forming portions Sb and Sc according to the second embodiment. In addition, a potential relationship between the charge upstream drum potential Vd1 and the charging bias Vc at respective timings is shown in FIG. 9. The suffixes b (magenta) and c (cyan) will be omitted in the following description.

In the second embodiment, in a similar manner to the first embodiment, the charging bias Vc2 is set to a voltage equal to or lower than the discharge start voltage Vth (Vc2=−450 V) in the color image forming portions Sb and Sc when the monochrome mode B is being executed. For this reason, as described earlier, a transition from the full-color mode to the monochrome mode B can be promptly made without performing a cleaning process of the charging roller 2. Therefore, both suppression of image defects due to ejection of contaminated toner from the charging roller 2 and the suppression of deterioration of the drum 1 can be achieved while reducing the wait time of the user.

In addition, in the second embodiment, a surface potential of the drum 1 is lowered in the monochrome mode B by subjecting the drum 1 to full-surface exposure using the scanner 3 and removing charges as shown in FIG. 9. In this description, full-surface exposure refers to exposure corresponding to a solid black image. In this case, a timing at which the full-surface exposure in the monochrome mode B is started is set to a timing that is the same, in terms of time, as a timing at which application of the transfer bias Vt1 is started.

In the second embodiment, due to such exposure control, the potential difference between the drum 1 and the charging roller 2 widens such that a side of the charging roller 2 increases toward a side of negative polarity as compared to the first embodiment. Specifically, after the potential of the drum 1 drops to −70 V due to the full-surface exposure by the scanner 3, the potential of the drum 1 drops to 0 V due to the application of the transfer bias Vt1. Therefore, at a time point when application of the charging bias Vc2 is started, although the charge upstream drum potential Vd1 is −50 V in the first embodiment, the charge upstream drum potential Vd1 drops to 0 V in the second embodiment. Accordingly, the potential difference ΔV1 at the charge upstream position which is 400 V in the first embodiment can be increased to 450 V in the second embodiment. Therefore, due to such a potential relationship, contaminated toner which is charged to a positive polarity and which adheres to the charging roller 2 can be more readily retained on the charging roller 2 and ejection can be further suppressed. In addition, since the potential of the drum 1 is controlled without performing discharge by the charging roller 2, deterioration of the drum 1 is not promoted.

As described above, by exposing the drum 1 and removing charge from the drum 1 using the scanner 3 in the color image forming portions Sb and Sc when the monochrome mode B is being executed as in the present embodiment, an occurrence of image defects due to ejection of contaminated toner of the charging roller 2 can be further suppressed.

Third Embodiment

Figure 10:
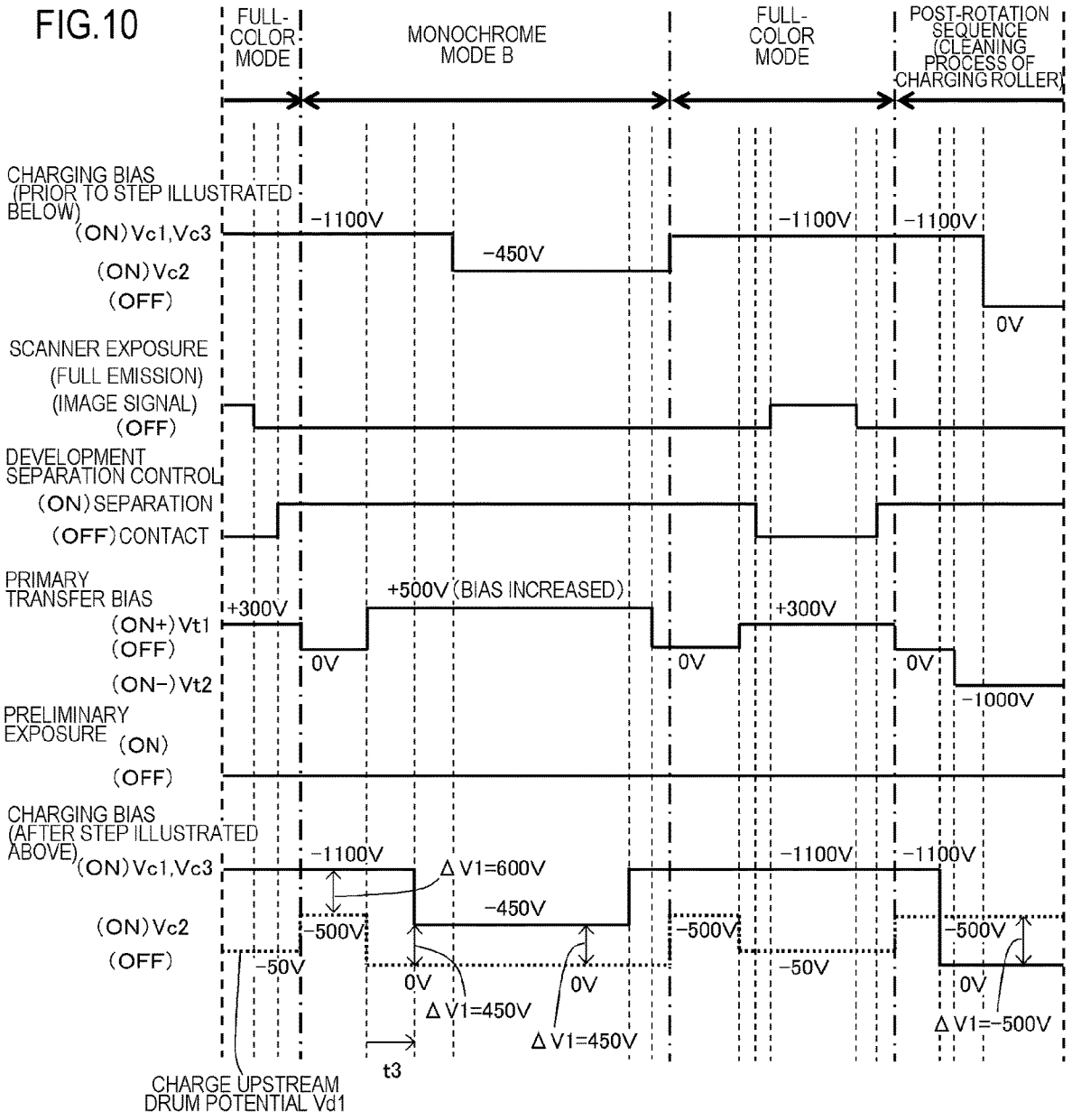
FIG. 10 is a timing chart during image formation including a monochrome mode B according to a third embodiment.

An image forming apparatus according to a third embodiment of the present disclosure will be described with reference to FIG. 10. Since an apparatus configuration of the image forming apparatus according to the third embodiment does not differ from the apparatus configuration of the image forming apparatus according to the first embodiment, a description thereof will be omitted below. A potential relationship between the charging roller 2 and the drum 1 which contributes to movement of toner will be described with reference to FIG. 10 while comparing control operations in chronological order with those of the first embodiment. FIG. 10 is a timing chart during image formation including the monochrome mode B in the color image forming portions Sb and Sc according to the third embodiment. In addition, a potential relationship between the charge upstream drum potential Vd1 and the charging bias Vc at respective timings is shown in FIG. 10. The suffixes b (magenta) and c (cyan) will be omitted in the following description.

In the third embodiment, in a similar manner to the first embodiment, the charging bias Vc2 is set to a voltage equal to or lower than the discharge start voltage Vth (Vc2=−450 V) in the color image forming portions Sb and Sc when the monochrome mode B is being executed. For this reason, as described earlier, a transition from the full-color mode to the monochrome mode B can be promptly made without performing a cleaning process of the charging roller 2. Therefore, both suppression of image defects due to ejection of contaminated toner from the charging roller 2 and the suppression of deterioration of the drum 1 can be achieved while reducing the wait time of the user.

In addition, in the third embodiment, a surface potential of the drum 1 is lowered in the monochrome mode B by further increasing the transfer bias Vt1 toward a side of positive polarity and injecting a charge to the drum 1 as shown in FIG. 10. In the present embodiment, the transfer bias Vt1 when the monochrome mode B is being executed as a second transfer bias is set to +500 V. In this case, a timing at which the application of the transfer bias Vt1 (+500 V) in the monochrome mode B according to the third embodiment is started is set to a timing that is the same as a timing at which application of the transfer bias Vt1 (+300 V) is started in the monochrome mode B according to the first embodiment.

In the third embodiment, due to such transfer bias control, the potential difference between the drum 1 and the charging roller 2 widens such that a side of the charging roller 2 increases toward a side of negative polarity as compared to the first embodiment. Specifically, at a time point when application of the charging bias Vc2 is started, although the charge upstream drum potential Vd1 is −50 V in the first embodiment, the charge upstream drum potential Vd1 drops to 0 V in the third embodiment. Accordingly, the potential difference ΔV1 at the charge upstream position which is 400 V in the first embodiment can be increased to 450 V in the third embodiment. Therefore, due to such a potential relationship, contaminated toner which is charged to a positive polarity and which adheres to the charging roller 2 can be more readily retained on the charging roller 2 and ejection can be further reduced. In addition, since the potential of the drum 1 is controlled without performing discharge by the charging roller 2, deterioration of the drum 1 is not promoted.

Next, time differences of the controls according to the first to third embodiments will be described. As shown in FIG. 10, a time t3 denotes a time from a timing when application of the transfer bias Vt1 (+500 V) is started and the surface of the drum 1 of which the surface potential has dropped to lower than the charging bias Vc2 (−450 V) reaches the charging roller 2 to a timing when application of the charging bias Vc2 is started in the third embodiment. The time t1 according to the first embodiment and the time t3 according to the third embodiment represent a same time. In a similar manner to the time t1 according to the first embodiment, the time t3 according to the third embodiment is set to a predetermined time such that, in order to suppress ejection of contaminated toner, the surface potential Vd1 of the drum 1 is lowered and the potential difference ΔV1 is increased prior to the application of the charging bias Vc2.

In addition, as shown in FIG. 9, a time t2 denotes a time from a timing when full-surface exposure is started and the surface of the drum 1 of which the surface potential has dropped to lower than the charging bias Vc2 (−450 V) reaches the charging roller 2 to a timing when application of the charging bias Vc2 is started in the second embodiment. In this case, in the second embodiment, a timing at which the full-surface exposure is started as described above is set to a timing that is the same, in terms of time, as a timing at which application of the transfer bias Vt1 is started in the first to third embodiments. For this reason, the time t2 is longer than the time t1 according to the first embodiment and the time t3 according to the third embodiment. This difference corresponds to a rotation time of the drum 1 from an exposed position on the surface of the drum 1 to the primary transfer position N1. Therefore, in the third embodiment, while further suppressing ejection of contaminated toner of the charging roller 2 than the first embodiment in a similar manner to the second embodiment, the surface potential of the drum 1 can be lowered at an earlier timing than the second embodiment to further reduce operation time.

As described above, by increasing the primary transfer bias Vt1 in a same polarity as during image formation in the color image forming portions Sb and Sc when the monochrome mode B is being executed as in the present embodiment, an occurrence of image defects due to ejection of contaminated toner of the charging roller 2 can be further suppressed. In addition, a switching time from the full-color mode to the monochrome mode B can be reduced as compared to control that involves removing charge by exposure using the scanner 3.

Fourth Embodiment

Figure 11:
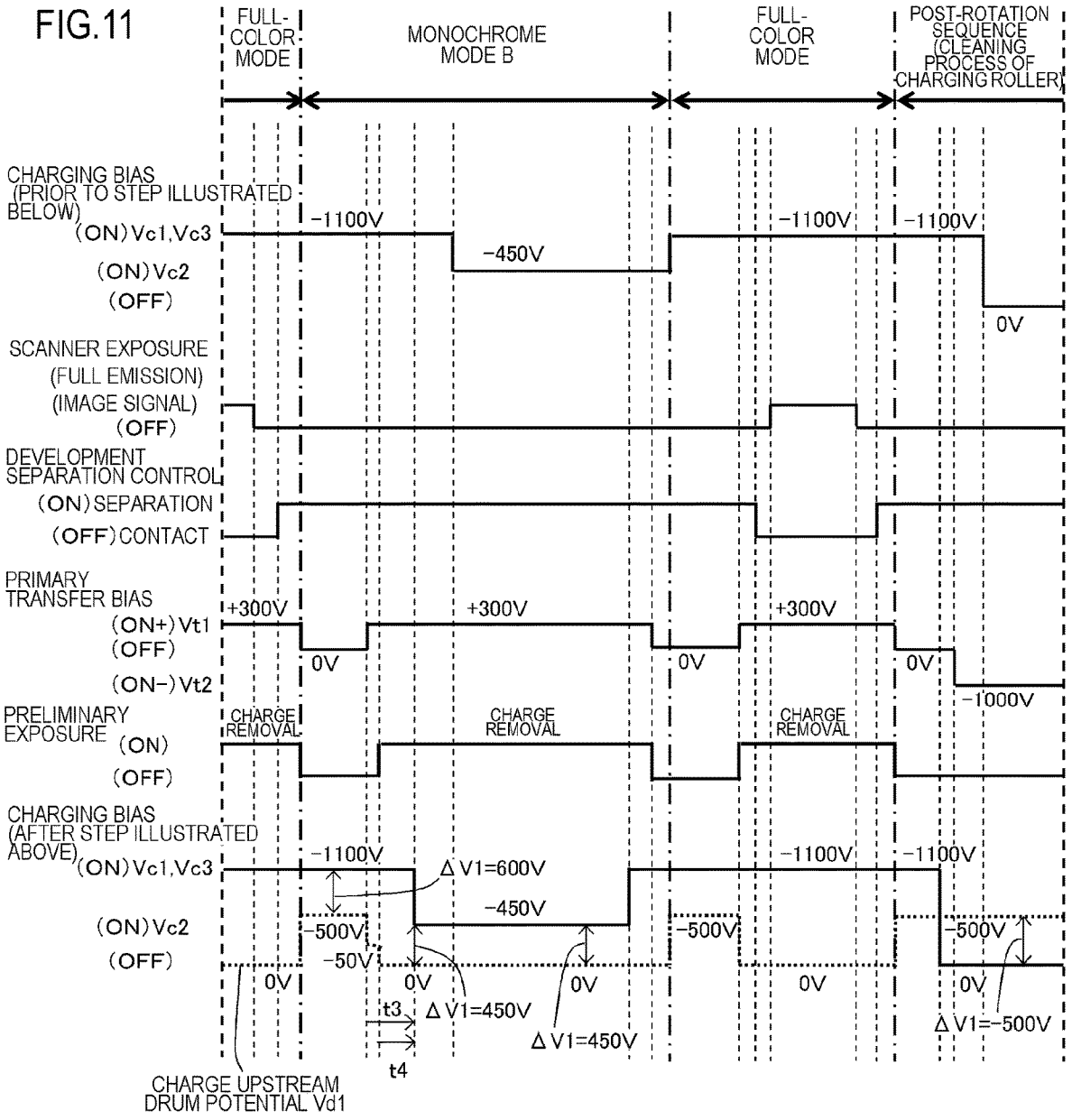
FIG. 11 is a timing chart during image formation including a monochrome mode B according to a fourth embodiment.

An image forming apparatus according to a fourth embodiment of the present disclosure will be described with reference to FIG. 11. Since an apparatus configuration of the image forming apparatus according to the fourth embodiment does not differ from the apparatus configuration of the image forming apparatus according to the first embodiment, a description thereof will be omitted below. A potential relationship between the charging roller 2 and the drum 1 which contributes to movement of toner will be described with reference to FIG. 11 while comparing control operations in chronological order with those of the first embodiment. FIG. 11 is a timing chart during image formation including the monochrome mode B in the color image forming portions Sb and Sc according to the fourth embodiment. In addition, a potential relationship between the charge upstream drum potential Vd1 and the charging bias Vc at respective timings is shown in FIG. 11. The suffixes b (magenta) and c (cyan) will be omitted in the following description.

In the fourth embodiment, in a similar manner to the first embodiment, the charging bias Vc2 is set to a voltage equal to or lower than the discharge start voltage Vth (Vc2=−450 V) in the color image forming portions Sb and Sc when the monochrome mode B is being executed. For this reason, as described earlier, a transition from the full-color mode to the monochrome mode B can be promptly made without performing a cleaning process of the charging roller 2. Therefore, both suppression of image defects due to ejection of contaminated toner from the charging roller 2 and the suppression of deterioration of the drum 1 can be achieved while reducing the wait time of the user.

In addition, in the fourth embodiment, a surface potential of the drum 1 is lowered in the full-color mode and the monochrome modes by subjecting the drum 1 having passed the primary transfer position N1 to exposure (preliminary exposure) using the preliminary exposing apparatus 7 and removing charges as shown in FIG. 11. In this case, a timing at which the preliminary exposure in the monochrome mode B is started is set to a timing that is the same, in terms of time, as a timing at which application of the transfer bias Vt1 is started.

In the fourth embodiment, due to such exposure control, the potential difference between the drum 1 and the charging roller 2 widens such that a side of the charging roller 2 increases toward a side of negative polarity as compared to the first embodiment. Specifically, after the potential of the drum 1 drops to −50 V due to the application of the transfer bias Vt1, the potential of the drum 1 drops to 0 V due to the preliminary exposure by the preliminary exposing apparatus 7. Therefore, at a time point when application of the charging bias Vc2 is started, although the charge upstream drum potential Vd1 is −50 V in the first embodiment, the charge upstream drum potential Vd1 drops to 0 V in the fourth embodiment. Accordingly, the potential difference ΔV1 at the charge upstream position which is 400 V in the first embodiment can be increased to 450 V in the fourth embodiment. Therefore, due to such a potential relationship, contaminated toner which is charged to a positive polarity and which adheres to the charging roller 2 can be more readily retained on the charging roller 2 and ejection can be further suppressed. In addition, since the potential of the drum 1 is controlled without performing discharge by the charging roller 2, deterioration of the drum 1 is not promoted.

Next, time differences of the control according to the fourth embodiment as compared with the first to third embodiments will be described. As shown in FIG. 11, a time t4 denotes a time from a timing when preliminary exposure is started and the surface of the drum 1 of which the surface potential has dropped to near 0 V reaches the charging roller 2 to a timing when application of the charging bias Vc2 (−450 V) is started in the fourth embodiment. In addition, in the second and third embodiments, the surface potential drops to near 0 V at the start of the application of the transfer bias Vt1 as shown in FIGS. 9 and 10. Therefore, a time from a timing when the surface of the drum 1 of which the surface potential has dropped to near 0 V reaches the charging roller 2 to a timing when application of the charging bias Vc2 (−450 V) is started is the time t3 described earlier. In this case, in the fourth embodiment, a timing at which the preliminary exposure is started is set to a timing that is the same, in terms of time, as a timing at which application of the transfer bias Vt1 is started in the first to third embodiments. For this reason, the time t4 is shorter than the time t1 according to the first embodiment and the time t3 according to the third embodiment. This difference corresponds to a rotation time of the drum 1 from the primary transfer position N1 to a position where the preliminary exposure is performed on the surface of the drum 1. Therefore, in the fourth embodiment, while further suppressing ejection of contaminated toner of the charging roller 2 than the first embodiment in a similar manner to the second and third embodiments, the surface potential of the drum 1 can be lowered to near 0 V at an earlier timing than the second and third embodiments to further reduce operation time.

As described above, according to the present embodiment, by exposing the drum 1 and removing charge from the drum 1 using the preliminary exposing apparatus 7 in the color image forming portions Sb and Sc when the monochrome mode B is being executed, an occurrence of image defects due to ejection of contaminated toner of the charging roller 2 can be further suppressed. In addition, a switching time from the full-color mode to the monochrome mode B can be reduced as compared to control that involves removing charge by full-surface exposure and control that involves increasing the primary transfer bias Vt1.

It should be noted that the configurations of the respective embodiments described above can be mutually combined to the greatest extent feasible. Specifically, preliminary exposure (the fourth embodiment) or scanner exposure (the second embodiment) may be performed while setting a larger primary transfer bias than during image formation (the third embodiment). In addition, while cases where the present disclosure is applied to an apparatus configuration adopting a so-called intermediate transfer system have been explained in the respective embodiments described above, apparatus configurations to which the present disclosure is applicable are not limited thereto. For example, the present disclosure may be applied to a configuration in which an image is individually and directly transferred to a recording material in each image forming portion or, in other words, an apparatus configuration that includes, as a transferred body, a transporting belt (a recording material bearing member) which sequentially transports borne recording material to each image forming portion. Since the problems addressed by the present disclosure described earlier may occur in such an apparatus configuration, similar effects to the embodiments described above can be obtained by applying the present disclosure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-051195, filed on Mar. 19, 2018, which is hereby incorporated by reference herein in its entirety.

What is claimed is:

1. An image forming apparatus, comprising:

a plurality of image forming portions each including an image bearing member which is rotatable, a charging member which comes into contact with the image bearing member and charges a surface of the image bearing member, and a developer carrying member which supplies toner to the image bearing member to form a toner image when moved to a developing position relative to the image bearing member and does not supply toner to the image bearing member when moved to a separating position relative to the image bearing member, the image forming portions being configured to form a toner image on the image bearing member;

an intermediate transfer member to which the toner image formed on the image bearing member is transferred;

a transferring member which transfers, to a recording material, the toner image having been transferred to the intermediate transfer member;

a charging voltage applying unit which applies a charging voltage to the charging member; and a control unit which controls the charging voltage applying unit, wherein the image forming portions are each configured to, in an image forming operation of forming the toner image on the recording material, recover toner remaining on the image bearing member without being transferred to the intermediate transfer member, using the developer carrying member, wherein, in the image forming operation, when the toner image is not formed in the image forming portion, which is a part of the plurality of image forming portions, the control unit controls the charging voltage applying unit so that a second charging voltage is applied to the charging member of the image forming portion that does not form the toner image, the second charging voltage having a smaller absolute value than a first charging voltage that is a charging voltage for forming the toner image, and having a same polarity as the first charging voltage, wherein the developer carrying member is moved to the developing position in a first image forming portion, of the plurality of image forming portions, that forms the toner image, and wherein the developer carrying member is moved to the separating position in a second image forming portion, of the plurality of image forming portions, that does not form the toner image.

2. The image forming apparatus according to claim 1, wherein the second charging voltage is a voltage with a smaller absolute value than a discharge start voltage.

3. The image forming apparatus according to claim 1, wherein the absolute value of the second charging voltage is larger than an absolute value of a surface potential of the image bearing member that is formed in the image forming portion that does not form the toner image.

4. The image forming apparatus according to claim 1, wherein the polarity of the second charging voltage is a same polarity as a normal polarity of the toner.

5. The image forming apparatus according to claim 1, wherein the control unit controls the charging voltage applying unit so as to apply the second charging voltage to the charging member of the image forming portion which does not form the toner image and which is not the image forming portion arranged most upstream in a rotation direction of the intermediate transfer member with a position where the toner image is transferred to the recording material by the transferring member as a reference.

6. The image forming apparatus according to claim 1, wherein the image forming apparatus has:

a multicolor image formation mode in which, by transferring toner images of different colors formed on the respective image bearing members of the plurality of image forming portions to the intermediate transfer member so as to overlap with each other, a multicolor toner image as a single toner image is transferred to the recording material; and a monochrome image formation mode in which, by transferring the toner image formed on the image bearing member in one of the plurality of image forming portions to the intermediate transfer member, a monochromatic toner image as a single toner image is transferred to the recording material, and wherein, in the monochrome image formation mode that is successively performed after the multicolor image formation mode, the control unit controls the charging voltage applying unit so as to apply the second charging voltage to the charging member in the image forming portion that does not form the toner image.

7. The image forming apparatus according to claim 6, wherein the image forming apparatus is configured to perform a cleaning process by moving toner adhered to the charging member to the image bearing member, and wherein, in the monochrome image formation mode that is successively performed after the cleaning process, the control unit controls the charging voltage applying unit so as not to apply the second charging voltage to the charging member in the image forming portion that does not form the toner image.

8. The image forming apparatus according to claim 7, wherein, while the monochrome image formation mode is repeated without performing the multicolor image formation mode after the cleaning process has been performed, the control unit controls the charging voltage applying unit so as not to apply the second charging voltage to the charging member in the image forming portion that does not form the toner image.

9. The image forming apparatus according to claim 7, wherein, when the second charging voltage is not applied in the monochrome image formation mode, the control unit controls the charging voltage applying unit so as not to apply the charging voltage to the charging member in the image forming portion that does not form the toner image.

10. The image forming apparatus according to claim 6, wherein an image forming portion that forms the toner image in the monochrome image formation mode is an image forming portion which is arranged most downstream in a rotation direction of the intermediate transfer member with a position where the toner image is transferred to the recording material by the transferring member as a reference, among the plurality of image forming portions.

11. The image forming apparatus according to claim 7, further comprising a cleaning member which cleans a surface of the intermediate transfer member, wherein in the cleaning process, toner moved to the image bearing member is moved to the intermediate transfer member and cleaned by the cleaning member.

12. The image forming apparatus according to claim 1, further comprising an exposing unit which exposes a surface of the image bearing member having been charged by the charging member, wherein the control unit controls the exposing unit to expose the image bearing member in the image forming portion that does not form the toner image.

13. The image forming apparatus according to claim 1, further comprising, in a transfer portion where the image bearing member of each of the plurality of image forming portions and the intermediate transfer member come into contact with each other, a transfer voltage applying unit which applies a transfer voltage to the intermediate transfer member so that a current flows from the intermediate transfer member to the image bearing member, wherein in the image forming portion that does not form the toner image, the control unit controls the transfer voltage applying unit so as to apply a second transfer voltage having a same polarity as a first transfer voltage for transferring the toner image from the image bearing member to the intermediate transfer member and having a larger absolute value than the first transfer voltage.

14. The image forming apparatus according to claim 1, wherein the plurality of image forming portions each include a second exposing unit which exposes a surface of the image bearing member on a downstream side of a position where the toner image formed on the image bearing member is transferred to the intermediate transfer member and on an upstream side of a position where the charging member comes into contact with the image bearing member in a rotation direction of the image bearing member, and wherein the control unit controls the second exposing unit to expose a surface of the image bearing member in the image forming portion that does not form the toner image.

15. The image forming apparatus according to claim 1, further comprising a developing/separating unit configured to move the developer carrying member to the developing position or the separating position relative to the image bearing member.

16. The image forming apparatus according to claim 1, wherein the toner is a single-component toner.

17. An image forming apparatus, comprising:

a plurality of image forming portions each including an image bearing member which is rotatable, a charging member which comes into contact with the image bearing member and charges a surface of the image bearing member, and a developer carrying member which supplies toner to the image bearing member when moved to a developing position relative to the image bearing member and does not supply toner to the image bearing member when moved to a separating position relative to the image bearing member, the image forming portions being configured to form a toner image on the image bearing member;

a transferred body which bears and transports a recording material and which transfers the toner image formed on the image bearing member to the recording material in a state of the image bearing member and the recording material being contacted with each other;

a charging voltage applying unit which applies a charging voltage to the charging member; and a control unit which controls the charging voltage applying unit, wherein the image forming portions are each configured to, in an image forming operation of forming the toner image on the recording material, recover toner remaining on the image bearing member without being transferred to the recording material, using the developer carrying member, wherein, in the image forming operation, when the toner image is not formed in the image forming portion, which is a part of the plurality of image forming portions, the control unit controls the charging voltage applying unit so that a second charging voltage is applied to the charging member of the image forming portion that does not form the toner image, the second charging voltage having a smaller absolute value than a first charging voltage that is a charging voltage for forming the toner image, and having a same polarity as the first charging voltage, wherein the developer carrying member is moved to the developing position in a first image forming portion, of the plurality of image forming portions, that forms the toner image, and wherein the developer carrying member is moved to the separating position in a second image forming portion, of the plurality of image forming portions, that does not form the toner image.

* * * * *